US005554984A

United States Patent [19]

Shigenaga et al.

[11] Patent Number: 5,554,984

[45] Date of Patent: Sep. 10, 1996

[54] ELECTRONIC TRAFFIC TARIFF RECEPTION SYSTEM AND VEHICLE IDENTIFICATION APPARATUS

[75] Inventors: Hisao Shigenaga; Ichiro Fujita; Masayuki Yamamoto, all of Kobe; Michio Hamana; Keiichi Morishita, both of Takasago; Fumitoshi Tachikawa, Nagoya; Hideo Uehara, Kobe; Yasuhisa Iida, Takasago, all of Japan

[73] Assignee: Mitsubishi Jukogyo Kabushiki Kaisha, Tokyo, Japan

[21] Appl. No.: 196,754

[22] Filed: Feb. 15, 1994

[30] Foreign Application Priority Data

Feb. 19, 1993 [JP] Japan ..... 5-030250
Feb. 19, 1993 [JP] Japan ..... 5-030251

[51] Int. Cl.[6] ..... G08G 1/00

[52] U.S. Cl. ..... 340/937; 340/928/933; 364/424.01

[58] Field of Search ..... 340/928, 937, 340/933; 364/436, 420.21; 235/384; 194/901

[56] References Cited

U.S. PATENT DOCUMENTS

| | | | |
|---|---|---|---|
| 5,101,200 | 3/1992 | Swett | 340/928 |
| 5,144,553 | 9/1992 | Hessett et al. | 340/928 |
| 5,204,675 | 4/1993 | Sekine | 340/937 |
| 5,253,162 | 12/1993 | Hessett et al. | 340/928 |

FOREIGN PATENT DOCUMENTS

| | | |
|---|---|---|
| 349413 | 1/1990 | European Pat. Off. . |
| 401192 | 12/1990 | European Pat. Off. . |
| 413948 | 2/1991 | European Pat. Off. . |
| 416692 | 3/1991 | European Pat. Off. . |
| 495708 | 7/1992 | European Pat. Off. . |
| 2670404 | 6/1992 | France . |
| 1261025 | 2/1968 | Germany . |
| 92/15978 | 9/1992 | WIPO . |

*Primary Examiner*—John K. Peng
*Assistant Examiner*—Edward Lefkowitz
*Attorney, Agent, or Firm*—Jacobson, Price, Holman & Stern, PLLC

[57] ABSTRACT

An electronic traffic tariff reception system can identify a vehicle traveling freely on a road having a plurality of lanes clearly and impose a predetermined debit value on the vehicle in the non-stop manner and in the cashless manner. Further, the system can photograph an image of an illegally passing vehicle. A vehicle identification apparatus can identify the vehicles traveling freely on the road having the plurality of lanes separately in a control point of the reception system. An in-vehicle unit equipped with a smart card is mounted in a vehicle. An antenna for debiting process capable of performing radio communication with the in-vehicle unit is provided. Also provided are an antenna controller for causing the antenna for the debiting process to receive personal information and vehicle information, a local controller for judging whether the information is normal or not or whether the vehicle is to be debited or not, and an apparatus for photographing an illegally passing vehicle. The in-vehicle unit is mounted in each of vehicles and at least one or more antennas are disposed above the road in association with each lane. When radio communication with the in-vehicle unit is made by way of the antennas, the antennas are started into a time sharing multiple accessing method.

9 Claims, 24 Drawing Sheets

| FIG. 7A |
| --- |
| FIG. 7B |

ELECTRONIC TRAFFIC TARIFF RECEPTION SYSTEM AND VEHICLE IDENTIFICATION APPARATUS

FIELD OF THE INVENTION AND RELATED ARTS

The present invention relates to an electronic traffic tariff reception system and a vehicle identification apparatus for use in the electronic traffic tariff reception system.

In a conventional traffic tariff reception system of a toll road, a reception person in a toll gate directly receives a toll or a traffic tariff in cash from a driver or the driver throws the traffic tariff in cash into an automatic machine to receive the traffic tariff automatically. Thus, the driver is required to stop at the toll gate once and provide cash for the traffic tariff.

On the contrary, there is being developed a near-future traffic tariff reception system including a communication apparatus such as a non-contact IC card provided in a vehicle and which stores information peculiar to the vehicle and can communicate by radio with an external apparatus.

An example of the above near-future traffic tariff reception system is now described with reference to FIG. 23. As shown in FIG. 23, an IC card 06 constituting the communication apparatus is attached on the inside of a windshield of a vehicle 07. The IC card 06 is provided with an antenna 026 and information such as an identification number peculiar to the vehicle is stored in the IC card 06.

On the other hand, in a toll gate, an outdoor terminal equipment 01 including transmitting and receiving antennas 017 and 018 is disposed for each traffic lane. The outdoor terminal equipment 01 is connected to a data processing unit (terminal computer) 05 in a toll booth and the data processing unit 05 is further connected to a central computer 04.

When the vehicle 07 including the IC card 06 mounted thereon passes by the outdoor terminal equipment 01, the vehicle enters in a communication area in which the vehicle can communicate with the antennas 017 and 018. At this time, the information peculiar to the vehicle is communicated between the outdoor terminal equipment 01 and the IC card 06 by radio. The information is recognized by the outdoor terminal equipment 01 and then transmitted to the data processing unit 05 to be stored in a memory. The information is further transmitted from the data processing unit 05 to the central computer 04. The central computer 04 performs a debiting process for clearing off the traffic tariff from a bank account registered by to the passing vehicle automatically.

The vehicle is identified by the radio communication between the IC card 06 of the vehicle 07 and the outdoor terminal equipment 01 in the non-contact manner. A cashless traffic tariff reception system which does not require the driver to stop at the toll gate can be attained to greatly improve the convenience of the driver.

Recently, in order to solve a traffic snarl in the midtown area and ensure smooth movement, there is a plan that vehicles going into the midtown area are debited and there is provided an area into which the vehicles are limited to enter.

In order to realize such a plan effectively without attendant, it is necessary to provide control points in all roads leading to the area and electronically impose fees on the vehicles going into the area by means of radio communication means. Information peculiar to the individual vehicles is recorded in each of the vehicles and a legal duty is imposed on each of the vehicles so as to mount an in-vehicle unit (IU) including the radio communication means. The in-vehicle unit is equipped with a credit card (hereinafter referred to as a smart card) constituted by an IC card in which personal information of a driver is recorded.

Generally, a road in the midtown area includes a plurality of lanes and it is difficult to ensure a place for providing partitions between the lanes in the control point as in the toll gate of the toll road.

Since the partitions can not be provided in the control point, it is anticipated that the vehicles travel on the lanes in parallel or travel to other lanes obliquely or travel astride between the lanes or travel at high speed (for example, at 120 km/h) or the road is crowded with vehicles.

Further, even in a single lane, it is anticipated that vehicles such as motorcycles travel on the same lane in parallel.

Even in such cases, it is necessary to provide a radio communication system and a vehicle separation method for identifying individual vehicles clearly and imposing the fees on the vehicles in the control point.

It is anticipated that the in-vehicle unit is not mounted in the vehicle, or the smart card is not mounted in the vehicle, or the in-vehicle unit or the smart card is illegal, or the in-vehicle unit or the smart card is listed in a blacklist, or the balance of the smart card is lacking.

The identification of vehicles and the imposition of fees can not be performed for the illegally passing vehicles described above. Even when the vehicle follows another vehicle closely with a distance of about 25 cm, for example, or even when the vehicles travel at a high speed, it is necessary to photograph an image including a license plate of the vehicle clearly and transmit the image to a central monitoring station without deterioration of the image quality to collate it.

Further, it is necessary to confirm whether the identification of vehicles and the imposition of fees at the control point are not wrong or not.

OBJECTS AND SUMMARY OF THE INVENTION

It is a first object of the present invention to provide an electronic traffic tariff reception system capable of identifying vehicles exactly to impose fees on the vehicles even if the vehicles travel in parallel or obliquely on a road having a plurality of lanes and performing photographing and collation of illegal vehicles and confirmation of the identification and the imposition.

It is a second object of the present invention to provide a vehicle identification apparatus capable of identifying vehicles exactly in control points of a traffic tariff reception system even if the vehicles travel in parallel or obliquely on a road having a plurality of lanes.

In order to achieve the first object of the present invention, the electronic traffic tariff reception system of the present invention comprises an in-vehicle unit mounted in a vehicle travelling freely across lanes of a road having one or two or more lanes and which stores vehicle information peculiar to individual vehicles and includes radio communication means, a smart card mounted in the in-vehicle unit and in which personal information of a driver is stored, at least one or more antennas for debiting process each disposed above each lane of the road, an antenna controller for controlling to receive the vehicle information and the personal information and transmit a debit value through the antenna for debiting process by means of radio communication with the in-vehicle unit, a local controller for judging whether the vehicle is to be debited or not on the basis of the vehicle information and the personal information received by the antenna for debiting process and the vehicle information and the personal information are normal or not and supplying a debit value in accordance with a vehicle type to the antenna controller when the vehicle is to be debited normally, at least one or more monitoring cameras each disposed above each lane of the road, a vehicle separator for detecting positions in the width direction and the length direction of the vehicle at a photographing position of the monitoring camera, and illegally passing vehicle photographing means for specifying by the vehicle separator a position of an illegally passing vehicle having the vehicle information or the personal information which is judged not to be normal by the local controller and causing the monitoring camera corresponding to the specified position to photograph the illegally passing vehicle.

When the in-vehicle unit receives the debit value from the antenna for debiting process, the in-vehicle unit can subtract the debit value from the balance recorded as the personal information in the smart card.

An antenna for confirmation is disposed ahead in the travelling direction of the vehicle with respect to the antenna for debiting process. The antenna controller receives the personal information through the antenna for confirmation from the in-vehicle unit of the vehicle after the vehicle has passed through the antenna for debiting process and confirms whether the debit value is subtracted exactly from the balance of the personal information or not.

When a plurality of antennas are provided, the antenna controller performs the radio communication in the time sharing manner in order to prevent interference between the antennas.

When a plurality of in-vehicle units transmit response signals to a response request signal from the antenna simultaneously and the response signals come into interference with each other in the antenna, the antenna controller controls to transmit the response request signal from the antenna repeatedly until the response signal is received exactly. On the other hand, the in-vehicle units transmit the response signals to the response request signal in the time sharing manner after a different delay time defined by random numbers.

There is provided a vehicle detector for detecting a position in the width direction of the vehicle. The antenna controller can start or operate only the antenna corresponding to or in association with the lane detected by the vehicle detector in order to prevent the interference between the antennas.

The vehicle detector can use a one-dimensional photosensor disposed above the road in the direction perpendicular to the traveling direction of the vehicle.

The vehicle detector includes a mark provided on the road at a detection position of the photosensor and having a concentration or the shade of color varying periodically in the perpendicular direction to the traveling direction of the vehicle in addition to the use of the one-dimensional photosensor disposed above the road in the direction perpendicular to the traveling direction of the vehicle.

The vehicle separator can use a one-dimensional photosensor disposed above the road in the direction perpendicular to the traveling direction of the vehicle.

The vehicle separator includes a mark provided on the road at the detection position of the photosensor and having a concentration or the shade of color varying periodically in the perpendicular direction to the traveling direction of the vehicle in addition to the use of the one-dimensional photosensor disposed above the road in the direction perpendicular to the traveling direction of the vehicle.

The local controller collates the vehicle information and the personal information obtained from the antenna controller with a blacklist and judges that the vehicle is not normal when the information is discovered from the blacklist, so that the local controller can cause the illegally passing vehicle photographing system to photograph the vehicle.

A prepaid card, a credit card or a postpaid card may be used as the smart card.

Since communication with the in-vehicle unit mounted in the vehicle can be performed by means of the antenna for debiting process, the personal information of a driver and the vehicle information peculiar to the vehicle can be obtained without stopping the vehicle even when the vehicles travel freely on a road having a plurality of lanes, so that the debit value corresponding to the vehicle type can be debited exactly without payment in cash. A time sharing multiple accessing method can be adopted as the communication method by means of the plurality of antennas. In this case, even when a plurality of vehicles travel in one communication area in parallel or continuously in close proximity to each other or at a high speed or in the crowd state, the plurality of vehicles can be identified exactly. Further, illegally passing vehicles having no smart card, no in-vehicle unit, an illegal smart card or an illegal in-vehicle unit can be specified by the vehicle separator and be photographed. Specifically, when the prepaid card system is adopted as the debiting system, whether the debit value is subtracted exactly or not can be confirmed by providing the antenna for confirmation.

In order to achieve the second object of the present invention, the vehicle identification apparatus of the present invention including an in-vehicle unit mounted in a vehicle travelling freely across lanes of a road having one or two or more lanes and which stores information peculiar to the vehicle and includes radio communication means and at least one or more antennas disposed above each lane of the road to thereby identify the vehicle by means of radio communication with the in-vehicle unit through the antenna is characterized in that the radio communication by the antenna is performed in the time sharing manner in order to prevent interference between antennas when a plurality of antennas are provided.

When a plurality of in-vehicle units transmit response signals to a response request signal from the antenna simultaneously and the response signals come into collision with each other in the antenna, the response request signal is transmitted to the in-vehicle units from the antenna repeatedly until the response signal is received exactly. On the other hand, when the in-vehicle unit does not receive a predetermined signal from the antenna within a predetermined time after the response signal has been transmitted, the in-vehicle unit may be re-transmit the response signal to the response request signal in the time sharing manner after a different delay time defined by random numbers.

By adopting the time sharing multiple accessing method as the communication method by the plurality of antennas when the vehicles travel freely on the road having a plurality of lanes, a plurality of vehicles can be identified exactly even when the plurality of vehicles travel in parallel or continuously in close proximity to each other or at a high speed or in the crowd state in one communication area.

DETAILED DESCRIPTION OF THE PREFERRED EMBODIMENTS

The present invention is now described in detail with reference to embodiments shown in the accompanying drawings.

[Embodiment 1]

Referring now to FIGS. 1 to 12, a first embodiment of an electronic traffic tariff reception system (hereinafter abbreviated as an ERP system) of the present invention is described.

The electronic traffic tariff reception system of the embodiment is applied to a plan that imposes a fee on a vehicle going into the midtown area so that an area into which the vehicles are limited to enter is provided, and is named a so-called three-gantry system.

The electronic traffic tariff reception system of the embodiment can be divided into three sections functionally.

One is a system for identifying vehicles travelling freely on a road having a plurality of lanes to impose a fee or a traffic tariff on the vehicles (hereinafter abbreviated as an AVID system).

Another is an illegally passing vehicle photographing system (hereinafter abbreviated as an ECS system) for photographing an image of an illegally passing vehicle to transmit the image data to a central monitoring station.

The remaining concerns an in-vehicle unit (hereinafter abbreviated as an IU) mounted to a vehicle.

Figure 1:
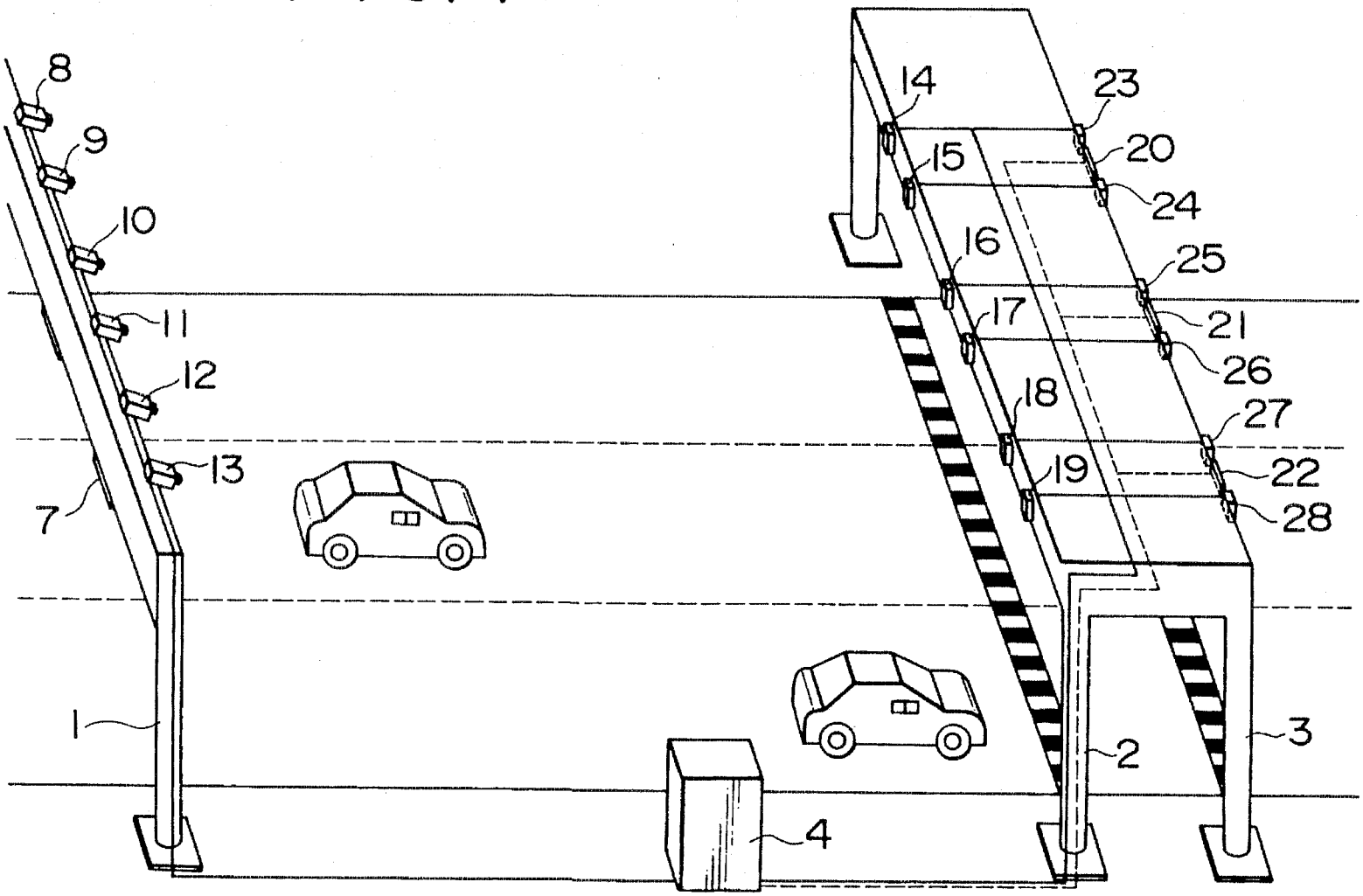
FIG. 1 is a perspective view illustrating a three-gantry system according to a first embodiment of an electronic traffic tariff reception system of the present invention.

In the embodiment, in order to realize functions of the AVID system and the ECS system mainly, outstations as shown in FIG. 1 are installed at control points in various places.

In the outstation, three gantries 1, 2 and 3 are disposed to stride a road and a control booth 4 is also disposed on the side of the road. The road includes three lanes and a plurality of vehicles travel freely on the road. A legal duty is imposed on each of the vehicles so as to mount the in-vehicle unit including radio communication means. The in-vehicle unit assumes the form of capable of mounting a smart card (SC) in which the personal information of a driver is recorded and it is described later in detail.

Figure 2:
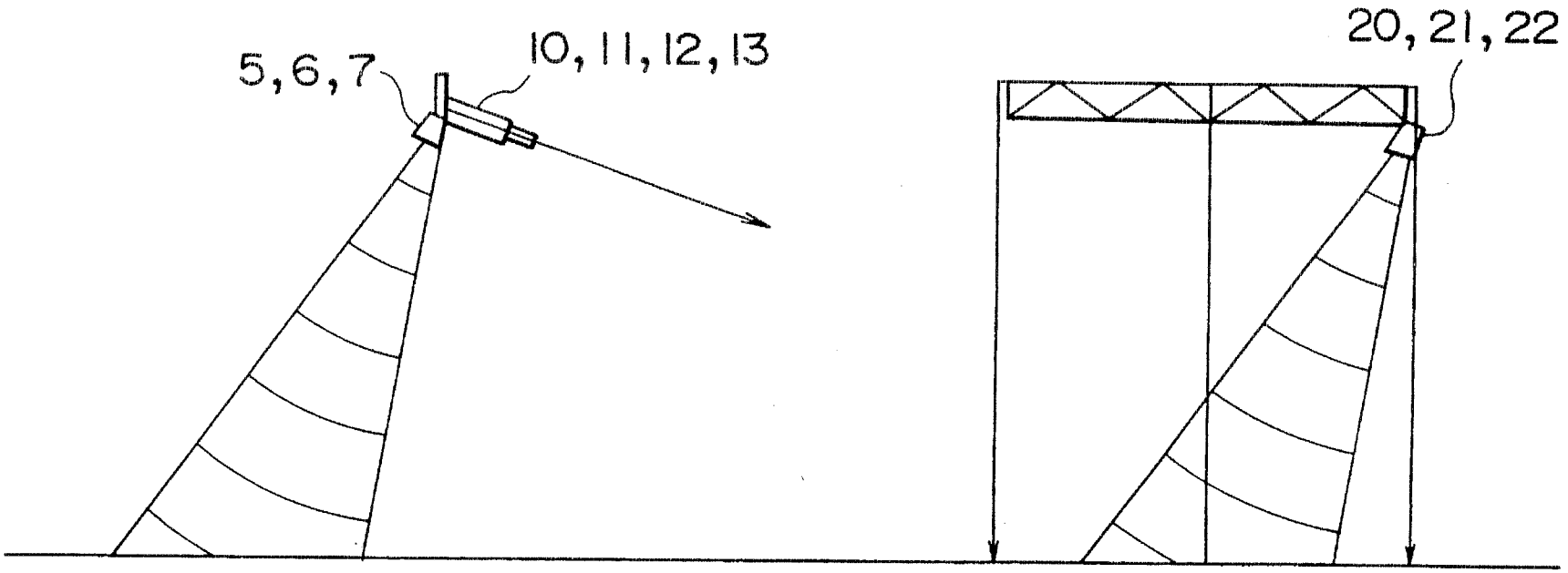
FIG. 2 is a schematic diagram illustrating a layout of the three-gantry system of the first embodiment.

As shown in FIG. 2, a distance between the first gantry 1 and the second gantry 2 is about 7 meters and a distance between the second gantry 2 and the third gantry 3 is about 5 meters in respect to the travelling direction of the vehicle.

Three antennas 5, 6 and 7 for debiting process are mounted on the first gantry 1 to correspond to the respective lanes in the direction perpendicular to the travelling direction of the vehicle and six monitoring cameras 8, 9, 10, 11, 12 and 13 for photographing illegally passing vehicles are also mounted on the first gantry 1 in the direction perpendicular to the travelling direction of the vehicle.

Each of communication areas of the antennas 5, 6 and 7 for debiting process is within a range from about 1 meter to about 3 meters ahead of the first gantry 1. Adjacent communication areas overlap each other partially. The antennas 5, 6 and 7 for debiting process perform the radio communication in microwaves and are accordingly designed in consideration of influence due to the natural condition such as rain, snow and the like.

The monitoring cameras 8 to 13 are mounted to be able to photograph an image including a license plate of passing vehicles at a position just after passing through the third gantry 3. The monitoring cameras 8 to 13 use a black-and-white CCD camera with an electronic shutter so as to be able to digitally process the photographed image. Although omitted in the drawings, it is desirable to provide an illumination device in consideration of the case where an mount of light in the outdoors is lacking.

Six vehicle detectors (hereinafter abbreviated as VPD) 14, 15, 16, 17, 18 and 19 are mounted on the second gantry 2 in the direction perpendicular to the travelling direction of the vehicle so that each pair of the vehicle detectors corresponds to each lane.

The vehicle detectors 14 to 19 use a one-dimensional CCD camera and photograph portions positioned just below the second gantry 2. A black-and-white periodic mark 2*a* is provided at the portions on the road in the direction perpendicular to the travelling direction of the vehicle. Accordingly, when there is no vehicle, the periodic mark 2*a* is photographed by the one-dimensional CCD cameras and a square wave having the same period as the periodic mark 2*a* is observed. When the periodic mark 2*a* is interrupted by the vehicle, the square wave is disturbed. The disturbed square wave is analyzed in the time sequential manner to detect positions in the length direction and the width direction of the vehicle.

When the one-dimensional CCD cameras are used as the vehicle detectors 14 to 19 as in the embodiment, the vehicle detectors can detect vehicles at intervals of about 25 cm in the width direction of the road and the travelling direction of the vehicle to thereby separate the vehicles including motorcycles and large-sized vehicles.

In the embodiment, the black-and-white grid mark is used as the periodic mark 2*a*, while another periodic pattern or mark may be used.

Three antennas for confirmation 20, 21 and 22 are mounted on the third gantry 3 in the direction perpendicular to the travelling direction of the vehicle and six vehicle separators (hereinafter abbreviated as VS) 23, 24, 25, 26, 27 and 28 are also mounted on the third gantry 3 in the direction perpendicular to the travelling direction of the vehicle so that each pair of the vehicle separators corresponds to each lane.

Each of communication areas of the antennas for confirmation 20, 21 and 22 is within a range of from about 1 meter to about 3 meters ahead of the third gantry 3. Further, adjacent communication areas overlap each other partially. The antennas for confirmation 20, 21 and 22 perform the radio communication in microwaves and are accordingly designed in consideration of influence due to the natural condition such as rain, snow and the like.

The vehicle separators 23 to 28 use a one-dimensional CCD camera and photograph portions positioned just below the second gantry 3. A black-and-white periodic mark 3*a* is provided at the portions on the road in the direction perpendicular to the travelling direction of the vehicle. Accordingly, when there is no vehicle, the periodic mark 3*a* is photographed by the one-dimensional CCD cameras and a square wave having the same period as the periodic mark 3*a* is observed. When the periodic mark 3*a* is interrupted by the vehicle, the square wave is disturbed. The disturbed square wave is analyzed in the time sequential manner to detect positions in the length direction and the width direction of the vehicle.

When the one-dimensional CCD cameras are used as the vehicle separators 23 to 28 as in the embodiment, the vehicle separators can detect vehicles with the resolution of about 25 cm in the width direction of the road and the travelling direction of the vehicle to thereby separate the vehicles including motorcycles and large-sized vehicles.

In the embodiment, the black-and-white grid mark is used as the periodic mark 2*a*, while another periodic pattern or mark may be used.

The vehicle separator can detect the vehicle even if ultrasonic waves or microwaves are used instead of the one-dimensional CCD camera, while the vehicle separator using ultrasonic waves or microwaves has a wide directivity and according can not attain the resolution of about 25 cm.

In order to control the antennas 5, 6 and 7 for debiting process, the antennas 20, 21 and 22 for confirmation, the vehicle detectors 14 to 19 and the vehicle separators 23 to 28, there are provided an antenna controller, a local controller, a vehicle detector master controller, a VS master controller, an ECS and the like in the control booth 4.

Figure 3:
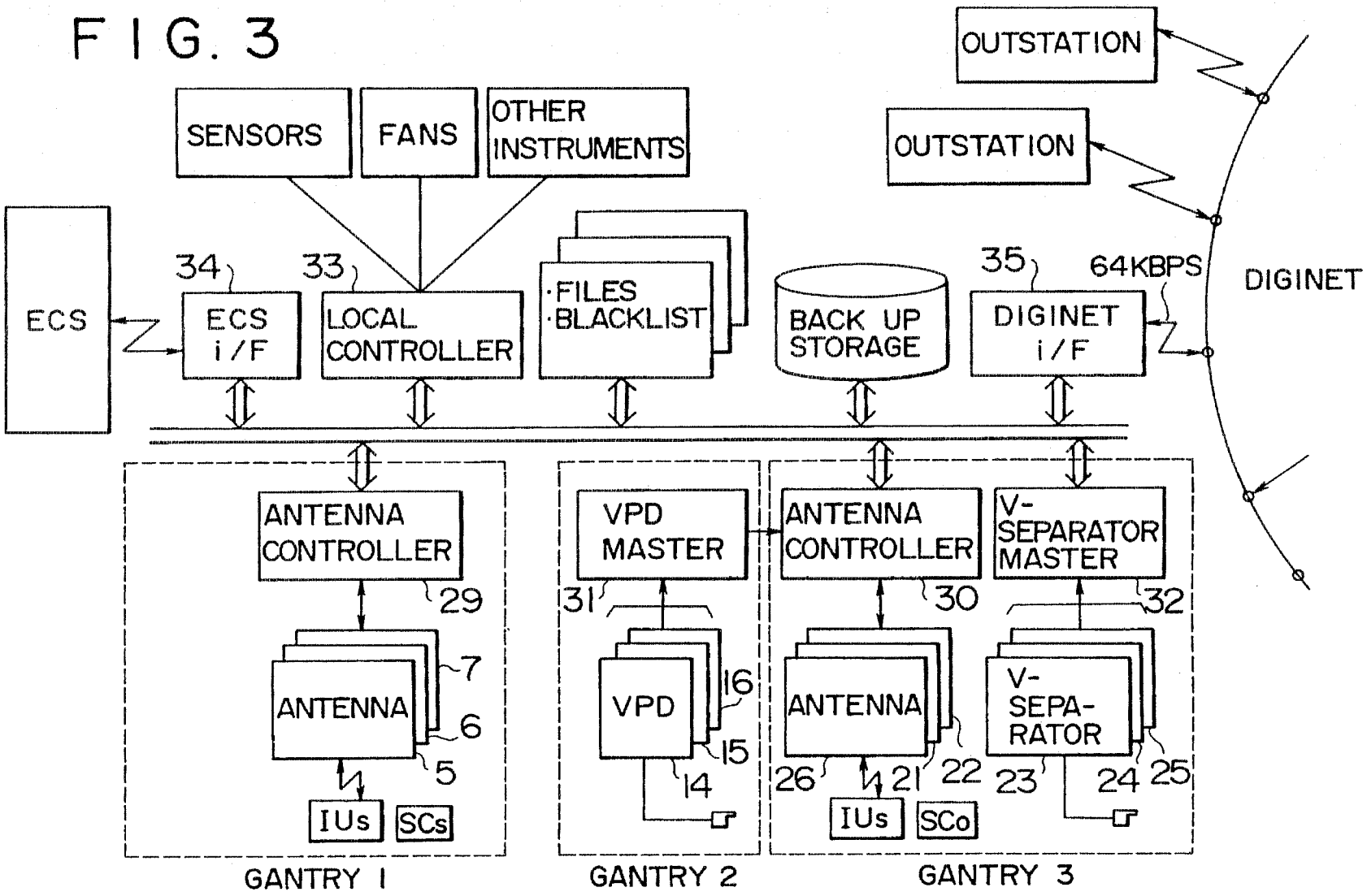
FIG. 3 is a block diagram schematically illustrating the three-gantry system of the first embodiment.

More particularly, as shown in FIG. 3, the antennas 5, 6 and 7 for debiting process are connected to an antenna controller 29 so that the antenna controller 29 receives the vehicle information and the personal information and transmits debiting information including a debit value by means of the radio communication with the in-vehicle unit through the antennas 5, 6 and 7 for debiting process.

The antenna controller 29 desirably adopts a time sharing multiple accessing method (TDMA) described later in order to avoid the interference between the antennas 5, 6 and 7 for debiting process and perform the debiting process with respect to a plurality of vehicles exactly.

The antennas 20, 21 and 22 for confirmation are connected to an antenna controller 30, which receives the vehicle information and the personal information by means of the radio communication with the in-vehicle unit through the antennas 20, 21 and 22 for confirmation.

The vehicle detectors 14 to 19 are connected to the vehicle detector master controller 31, which supplies position information of a front end and a rear end of the vehicle detected by the vehicle detectors 14 to 19 to the antenna controller 30 to start a specific antenna for confirmation.

Further, the vehicle separators 23 to 28 are connected to a vehicle separator master controller 32. The controller 32 sends position information of a rear end of the vehicle detected by the vehicle separators 23 to 28 to the illegally passing vehicle photographing system (ECS). In the case of an illegally passing vehicle, an image including a license plate of the vehicle is photographed by the monitoring cameras 8 to 13.

The antenna controllers 29 and 30, the vehicle detector master controller 31 and the vehicle separator master controller 32 are connected to a local controller 33. The local controller 32 judges whether the vehicle is to be debited or not on the basis of the vehicle information and the personal information received by the antennas for confirmation 5, 6 and 7 and whether the vehicle information and the personal information are normal or not. When the vehicle is to be debited normally, the local controller supplies a debit value in accordance with a type of the vehicle to the antenna controller 29. Further, the vehicle information and the personal information obtained from the antenna controller 29 are collated with a blacklist. When the vehicle information and the personal information are detected in the blacklist, it is determined that the vehicle is not normal and the illegally passing vehicle photographing system (ECS) is caused to photograph the vehicle.

The illegally passing vehicle photographing system (ECS) specifies by means of the vehicle separators 23 to 28 a position of the illegally passing vehicle having the vehicle information or the personal information which is determined by the local controller 33 not to be normal or which is detected in the blacklist and is regarded by the local controller 33 to be illegal. The illegally passing vehicle photographing system causes the monitoring camera 8–13 corresponding to the specified position to photograph the illegally passing vehicle.

Communication between the illegally passing vehicle photographing system (ECS), the local controller 33 and the vehicle separator master controller 32 can be made through an illegally passing vehicle photographing system (ECS) interface 34.

The local controller 33 can communicate with a high-speed digital communication network (diginet) such as ISDN connected to a central computer system (CCS) through a diginet interface 35. Further, a backup storage is provided. The local controller is provided with other instruments, sensors and fans.

Figure 4:
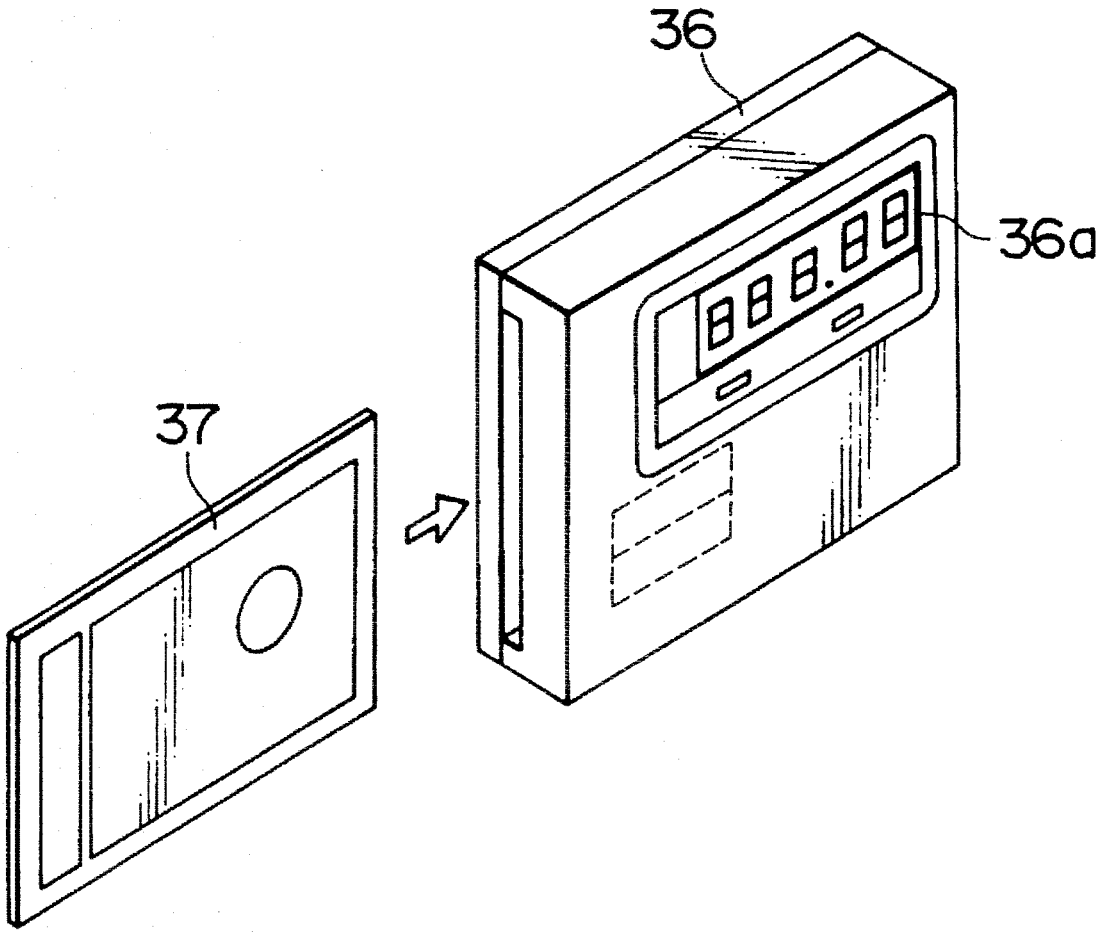
FIG. 4 is a perspective view illustrating an in-vehicle unit and a smart card.

An example of the in-vehicle unit and the smart card is shown in FIG. 4. As shown in FIG. 4, the in-vehicle unit 36 has a structure that the smart card 37 is mounted in the in-vehicle unit and includes a liquid crystal display 36*a* mounted in the front surface thereof.

The in-vehicle unit 36 stores peculiar vehicle information such as, for example, an in-vehicle unit code, an in-vehicle unit type, a manufacturing date and the like and includes radio communication means not shown.

The smart card 37 stores driver's personal information such as, for example, a smart card code, a driving license number, a debiting history or transaction and the like, and uses a prepaid card in the embodiment.

When the smart card 37 is inserted into the in-vehicle unit 36, information in the smart card 37 is sent to the in-vehicle unit 36 and stored in the unit after the authentication. When any error occurs in the authentication, its history is recorded. Further, when the smart card 37 is pulled out from the in-vehicle unit 36, the information of the smart card 37 is erased.

Public vehicles which are exempted from the debiting such as a bus and vehicles for the police and the fire fighting are set to have IU type of 4, for example, and are judged not to be the illegally passing vehicle even if the smart card 37 is not mounted in the in-vehicle unit 36.

Figure 5:
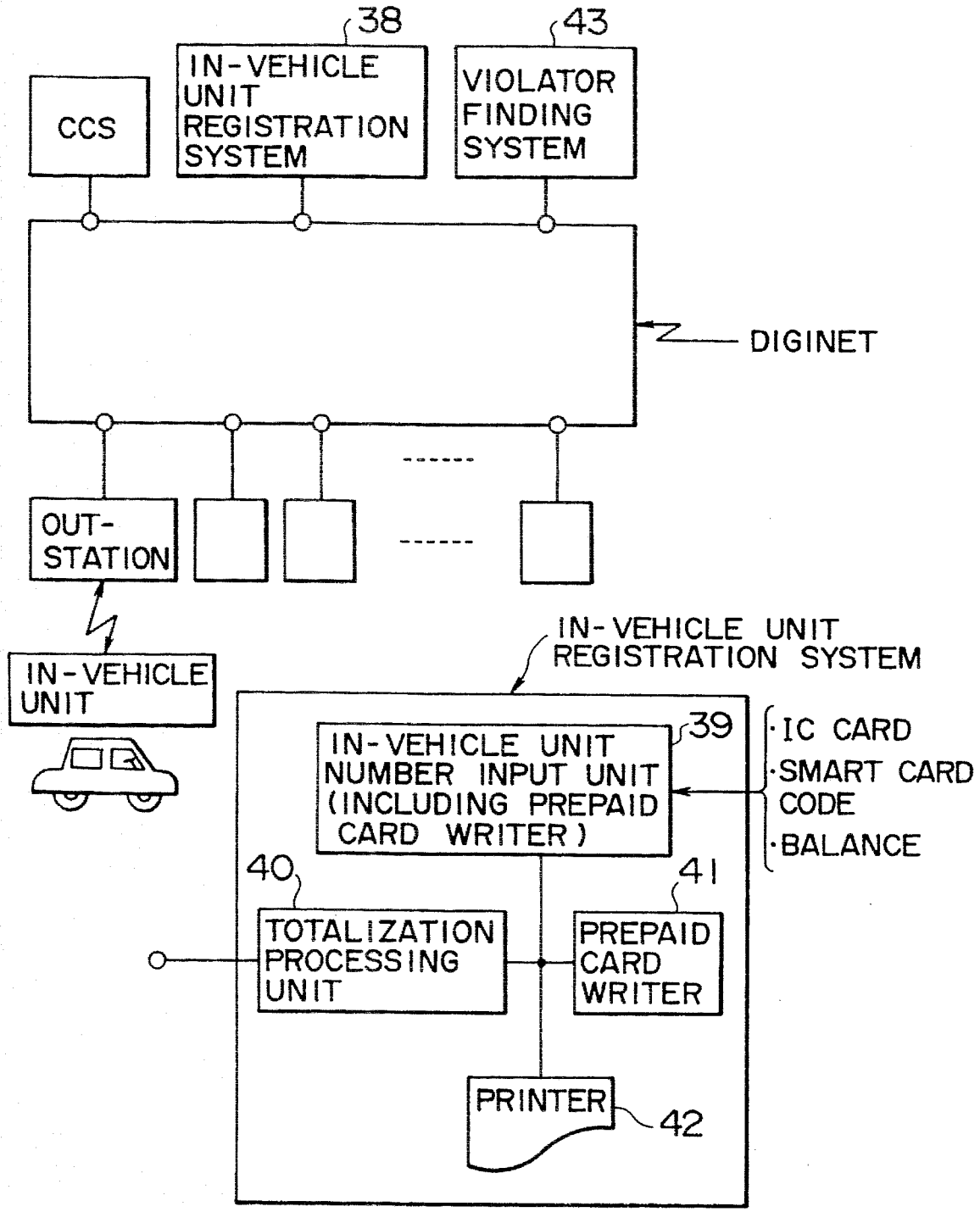
FIG. 5 is a schematic diagram illustrating a prepaid card system.

A payment method adopts the prepaid system shown in FIG. 5. The prepaid system uses an in-vehicle unit registration system 38 connected through the diginet.

The in-vehicle unit registration system 38 includes an in-vehicle unit number input unit 39, a totalization processing unit 40, a prepaid card writer 41 and a printer 42. An IU code, a smart card code and a balance are inputted in the in-vehicle unit number input unit 39. The smart card code and the balance are recorded in the IC card constituting the smart card by means of the prepaid card writer 41 and are sent through the totalization processing unit 40 to the central computer system (CCS).

In order to prevent injustice in the prepaid system, it is desirable to provide a violator finding system.

Figure 6A:
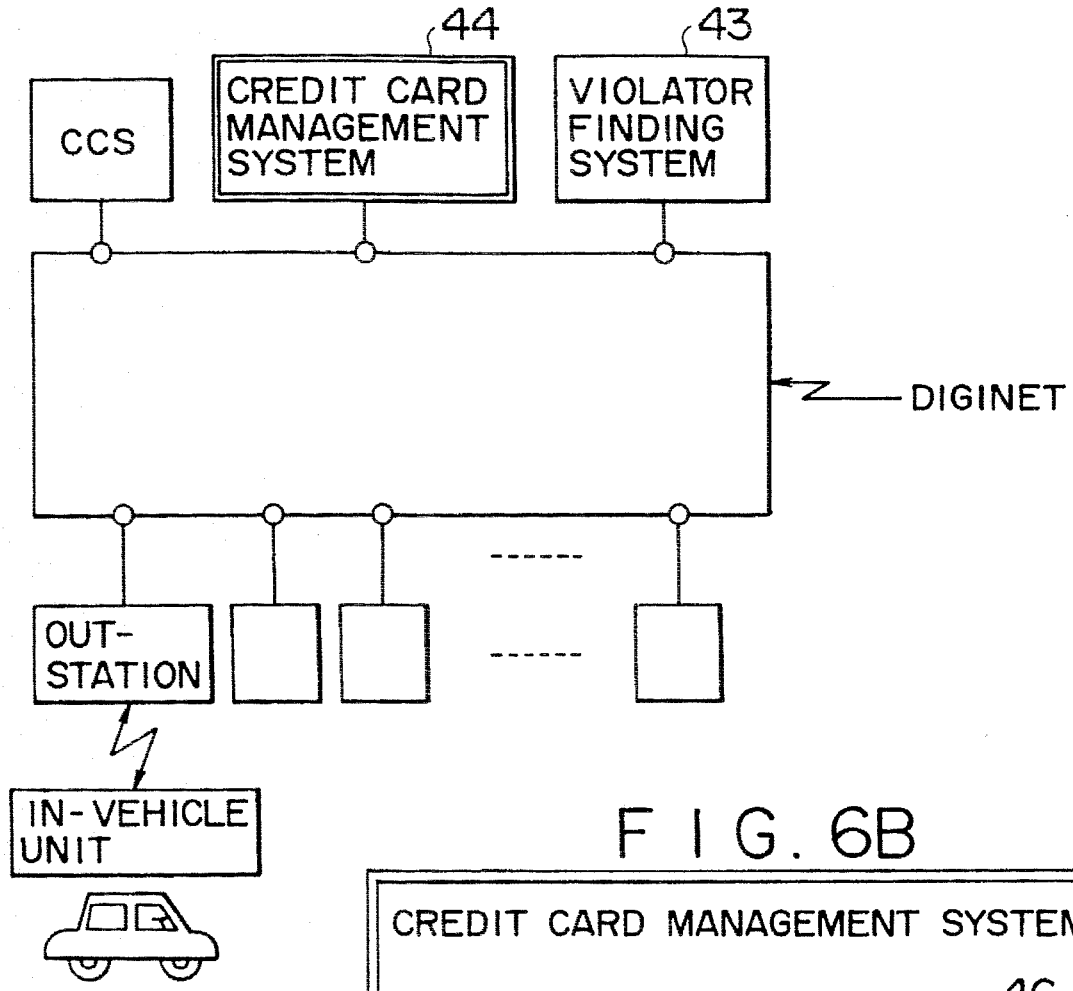
FIGS. 6A and 6B are schematic diagrams illustrating a credit card system.
Figure 6B:
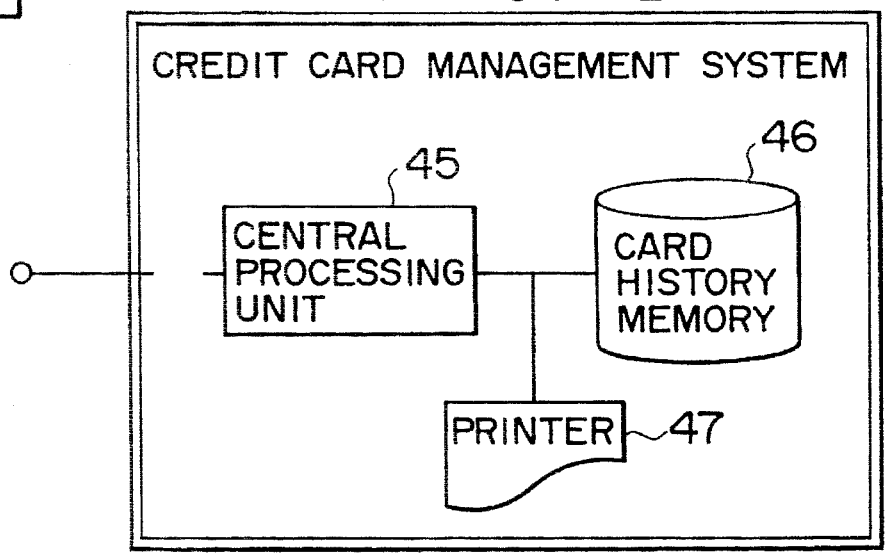

Further, it is possible to adopt a credit card system as shown in FIGS. 6A and 6B as the payment method of the smart card. The credit card system uses a credit card management system 44 connected through the diginet.

The credit card management system 44 includes a central processing unit 45, a card history memory 46 and a printer 47.

The payment system is not limited particularly and may be a postpaid system and a deposit system.

Figure 12:
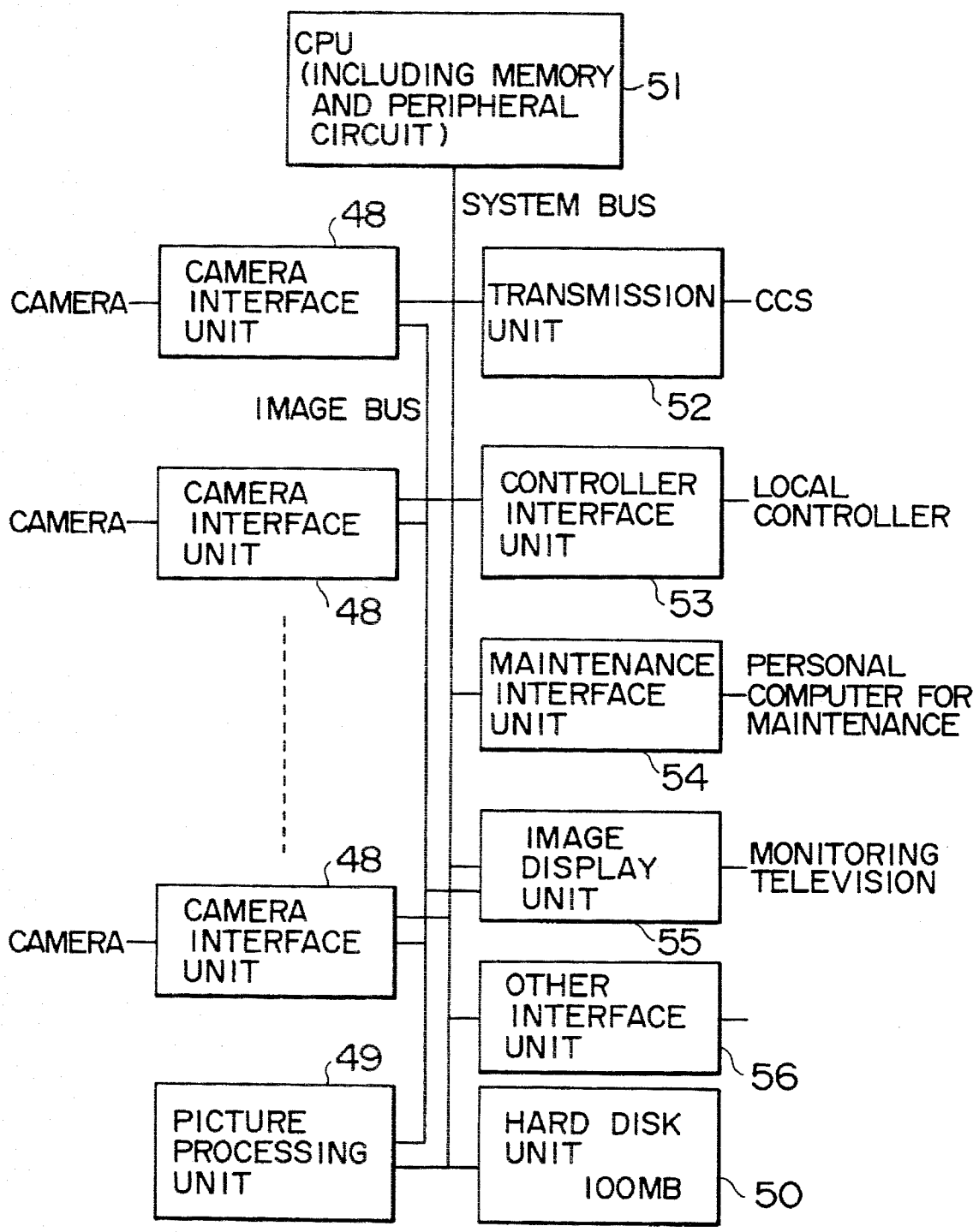
FIG. 12 is a schematic diagram illustrating an illegally passing vehicle photographing system.

The illegally passing vehicle photographing system (ECS) includes, as shown in FIG. 12, a plurality of monitoring cameras, camera interface units 48, a picture processing unit 49, a hard disk unit 50, a CPU 51, a transmission unit 52, a controller interface unit 53, a maintenance interface unit 54, an image display unit 55, and other interface unit 56.

The CPU 51 includes a memory necessary for operation of the system and a control circuit necessary for the interrupt control and others and controls the whole operation of the illegally passing vehicle photographing system (ECS).

The camera interface unit 48 includes two sets of frame memories for storing a shutter command to the camera, taking in of an image, automatic control of a diaphragm of the camera and a cameral image and can read information from one frame memory while taking an image into the other frame memory.

The picture processing unit 49 is a hardware for performing compression and extension of a picture or image taken by the camera in a predetermined manner.

The hard disk unit 50 can store a compressed image from the camera and additional information.

The transmission unit 52 is a transmission interface for transmitting the compressed image and the image additional information to the central computer system (CCS) and receiving a designated image communication command, time, other necessary variable information, setting information and the like from the central computer system (CCS).

The controller interface unit 53 is an interface for the local controller mainly and receives illegally passing vehicle information corresponding to a photographing command interrupt and a photographing command and transmits a photographing process condition.

The maintenance interface unit 54 is an interface for connecting a personal computer for the purpose of maintenance or adjustment.

The image display unit 55 is provided with a frame memory for display and an interface capable of superposing characters, a cursor and a frame line.

The other interface unit 56 is provided with an interface for an external light illuminometer and an interface for illuminator control if necessary.

The illegally passing vehicle photographing system (ECS) photographs only the illegally passing vehicle, although the system may photograph all of passing vehicles and leave only image information of the illegally passing vehicles by removing image information of normally passing vehicles.

An implementation method of the electronic traffic tariff reception system (ERP) of the embodiment is now described with reference to FIGS. 7 to 11.

Figures 7, 7A:
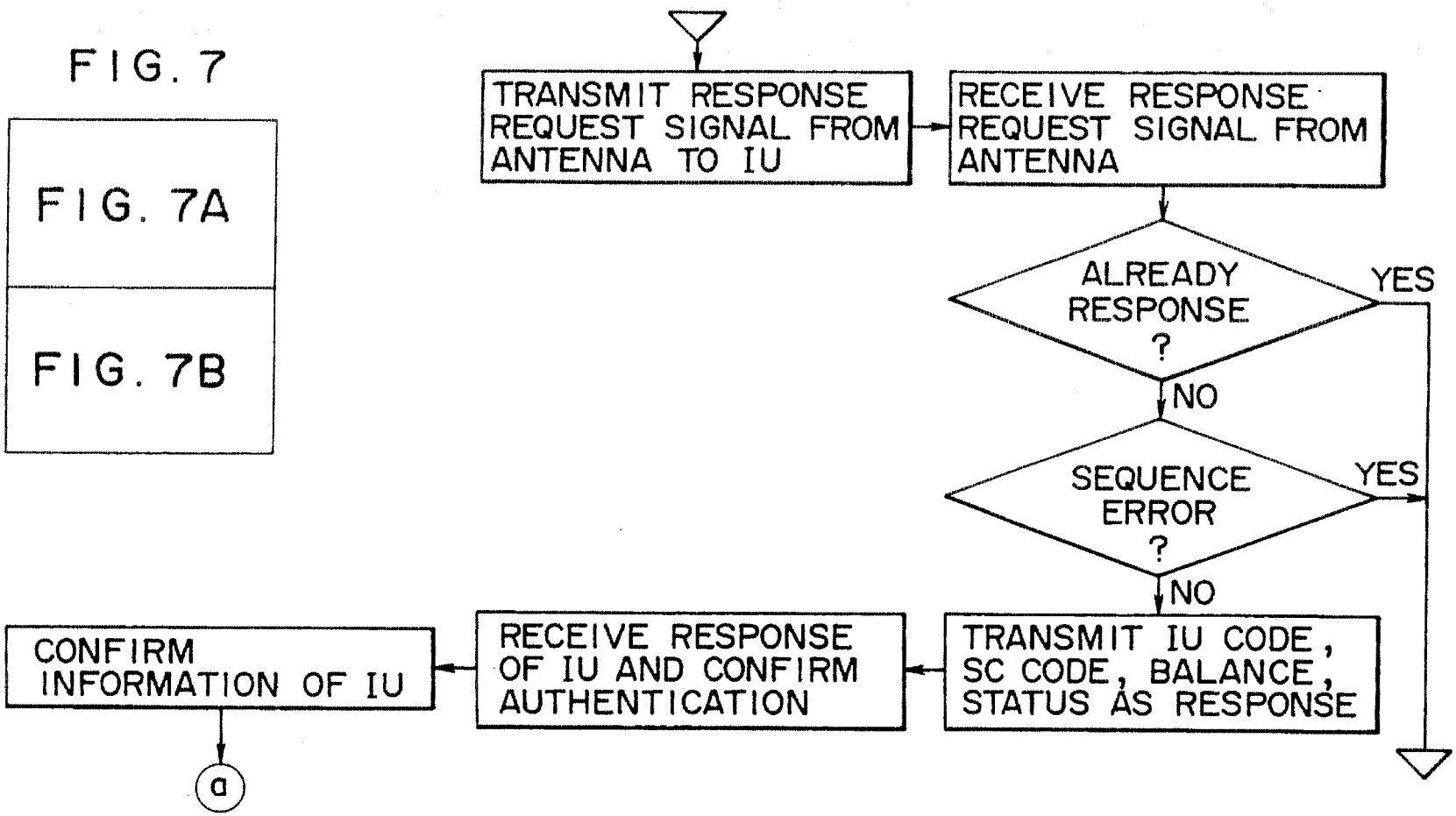
FIGS. 7A and 7B are flow charts showing operation of the electronic traffic tariff reception system of the present invention.
Figure 7B:
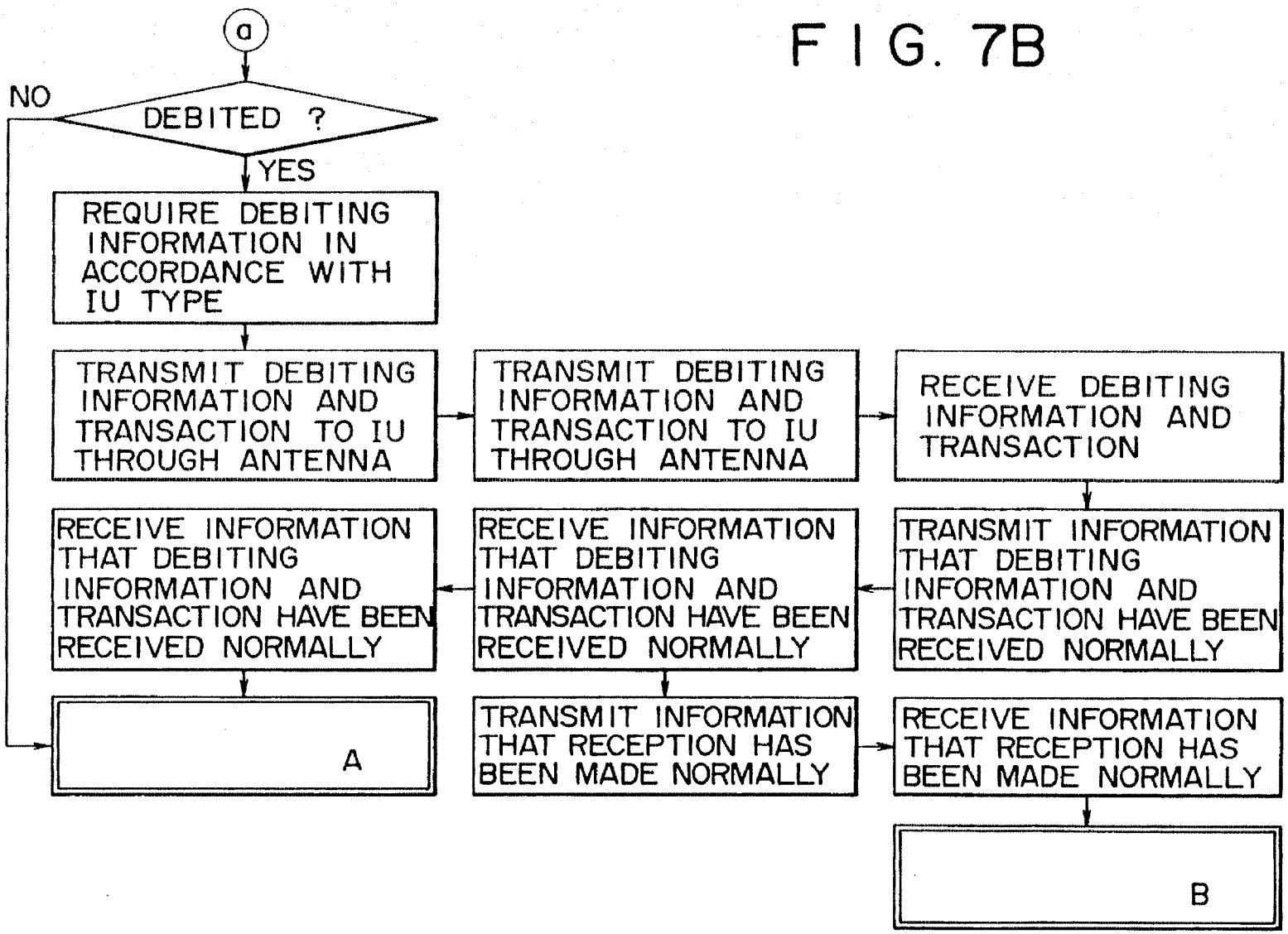

First of all, as shown in FIG. 7, in the first gantry 1, the antenna controller 29 controls to always transmit the response request signal to the in-vehicle unit 36 from the antennas for debiting process 5, 6 and 7. The response request signal includes data such as an antenna number, time, place and lane position. The response request signal further includes random numbers for authentication of the antennas for debiting process 5, 6 and 7 and the in-vehicle unit 36 for the purpose of prevention of illegality.

The in-vehicle unit 36 mounted in the vehicle passing through the first gantry 1 receives the response request signal and performs the authentication with the antennas for debiting process 5, 6 and 7 by means of the random numbers. After confirmation of the response request signal, the in-vehicle unit 36 transmits a response signal to the antennas for debiting process 5, 6 and 7. The in-vehicle unit 36 is usually in a sleeping state and is started by the response request signal.

The response signal includes data such as an antenna number, time, place, lane position, in-vehicle unit code, smart card code, balance and error information. Further, the response signal includes new random number for authentication of the antennas for debiting process 5, 6 and 7 and the in-vehicle unit 36 for the purpose of prevention of illegality. The error information includes error information for authentication of the in-vehicle unit 36 and the smart card 37.

Further, before the in-vehicle unit 36 transmits the response signal, the in-vehicle unit 36 confirms whether the in-vehicle unit does not respond to the antennas for debiting process 5, 6 and 7 yet or whether there is no sequence error that the in-vehicle unit passes through the second gantry 2 before passing through the first gantry 1 by reversely travelling on the road.

When the antenna controller 29 has received the response signal from the in-vehicle unit 36 through the antennas for debiting process 5, 6 and 7, the antenna controller 29 makes authentication with the in-vehicle unit 36 by means of new random numbers and transmits the data to the local controller 33.

In the embodiment, the authentication of the in-vehicle unit 36 and the antennas for debiting process 5, 6 and 7 is made by means of random number, while a telegraphic message may be converted into a secret message by any method in order to prevent the illegality perfectly.

Figure 8:
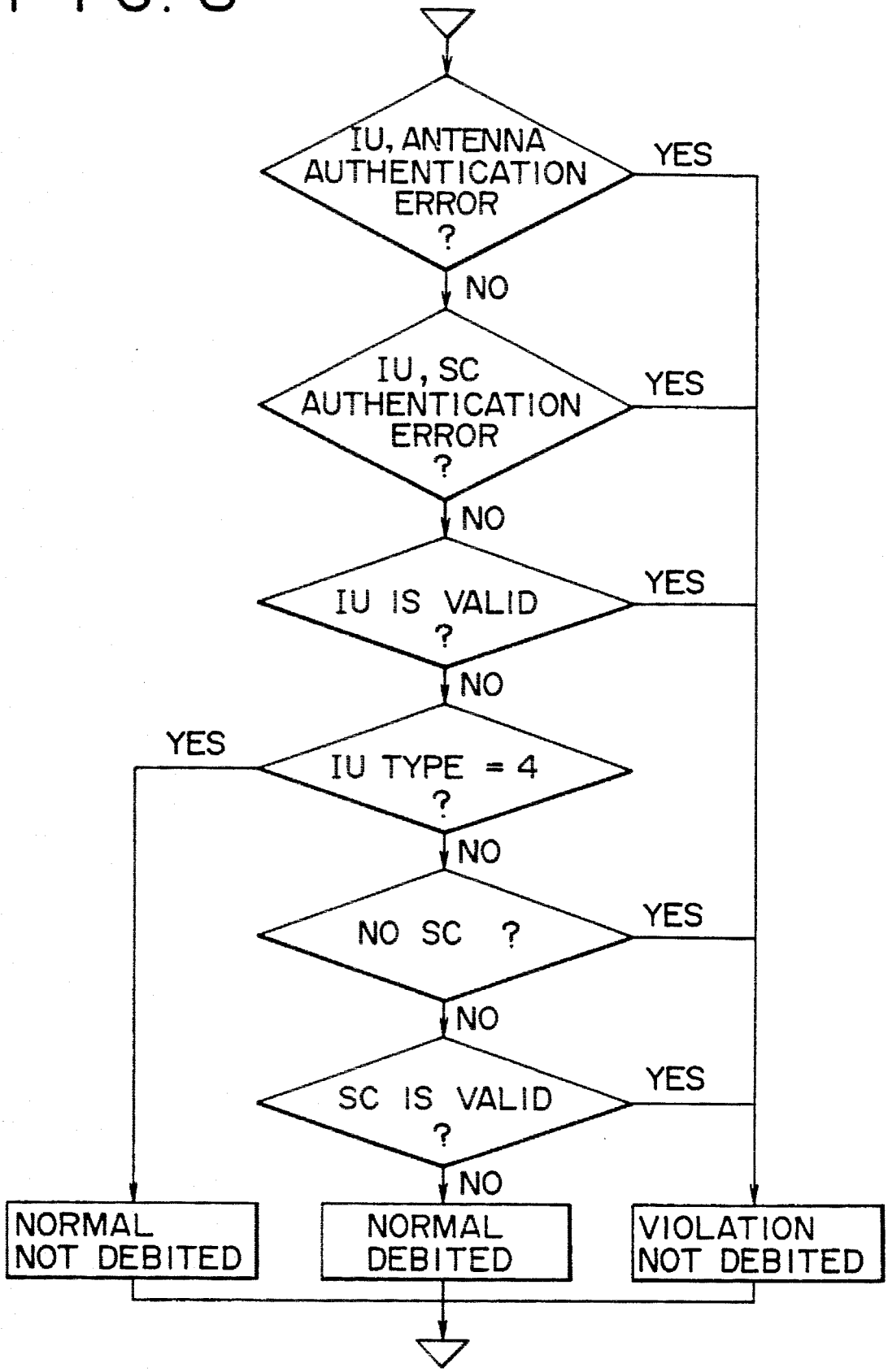
FIG. 8 is a flow chart showing operation of the electronic traffic tariff reception system of the present invention.

The local controller 33 receives the vehicle information and the personal information from the in-vehicle unit 36 and confirms the information as shown in FIG. 8 as follows:

(1) Authentication error of the in-vehicle unit 36 and the antenna (2) Authentication error of the in-vehicle unit 36 and the smart card 37

(3) Validity of the in-vehicle unit (4) Type of the in-vehicle unit (5) Presence of the smart card (6) Validity of the smart card When there is any violation of the above items (1), (2), (3), (5) and (6), the vehicle is an illegally passing vehicle and can not be debited. When there is no problem for the above items (1), (2), (3), (5) and (6), the vehicle is to be debited normally. When the type of the in-vehicle unit is 4 in the above item (4), the vehicle is a public vehicle such as a bus which is exempted from the debiting and accordingly the vehicle is not debited. This result is recorded as a communication result.

When the vehicle is to be debited, a debit value in accordance with the type of the in-vehicle unit is read out and the debiting information including the debit value and the transaction is transmitted to the in-vehicle unit 36 through the antenna for debiting process 5, 6, 7 specified by the antenna number.

The in-vehicle unit 36 which has received the debiting information including the debit value transmits a reception completion signal informing that the debiting information such as the debit value has been received normally to the antennas for debiting process 5, 6 and 7. The antenna controller 29 which has received the reception completion signal through the antennas for debiting process 5, 6 and 7 transmits to the local controller 33 and the in-vehicle unit 36 the information that the reception completion signal has been received normally. At this time, authentication is made by random numbers in the same manner as above.

When the balance of the smart card 37 is smaller than the debit value, the debiting process can not be made and accordingly after the debit value is read out, the vehicle is treated as an illegally passing vehicle which can not be debited normally. In the drawing, its process is omitted.

Figure 9:
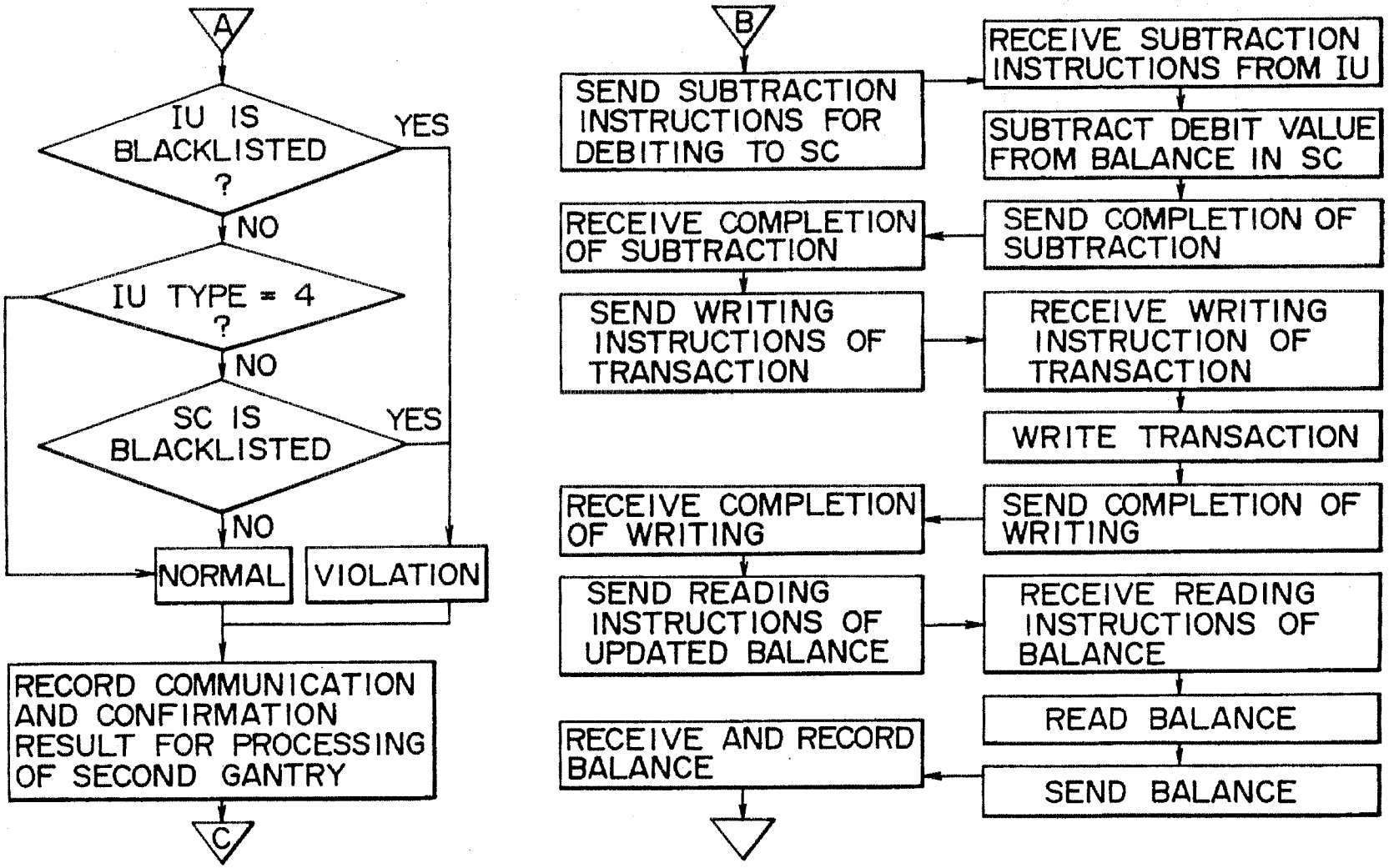
FIG. 9 is a flow chart showing operation of the electronic traffic tariff reception system of the present invention.

After the local controller 33 has received the reception completion signal, the local controller 33 performs the following processes as shown in FIG. 9 until the vehicle reaches the second gantry.

(7) Examine the blacklist of the in-vehicle unit 36

(8) Examine blacklist of the smart card

When the in-vehicle unit or the smart card is blacklisted, the vehicle is regarded as the illegally passing vehicle which can not be debited normally.

This result is recorded as a communication result for the purpose of the confirmation process upon passage of the second gantry. In the blacklist, vehicles having the history that the in-vehicle unit code, the smart card code or the like is changed illegally in the past are registered previously. The blacklist is provided in all of the outstations. The outstations communicate with the central computer system (CCS) periodically to update the blacklist. When the postpaid system is adopted as the debiting system, the blacklist includes the vehicle having the balance of the bank account from which the subtraction process can not be made normally.

The in-vehicle unit 36 performs the following process until the vehicle reaches the second gantry 2.

First of all, the in-vehicle unit 36 sends subtraction instructions for debiting to the smart card 37. The smart card 37 which has received the subtraction instructions subtracts the debit value from the balance in the smart card and sends completion of the subtraction to the in-vehicle unit 36.

Then, the in-vehicle unit 36 which has received the completion of subtraction sends writing instructions of the transaction to the smart card 37. The smart card 37 which has received the writing instructions of the transaction performs writing of the transaction and sends completion of the writing to the in-vehicle unit 36.

Further, the in-vehicle unit 36 which has received the completion of writing sends reading instructions of the updated balance to the smart card 37. The smart card 37 which has received the reading instructions reads the updated balance and sends the updated balance to the in-vehicle unit 36.

The in-vehicle unit 36 which has received the updated balance records the balance therein.

Figure 10A:
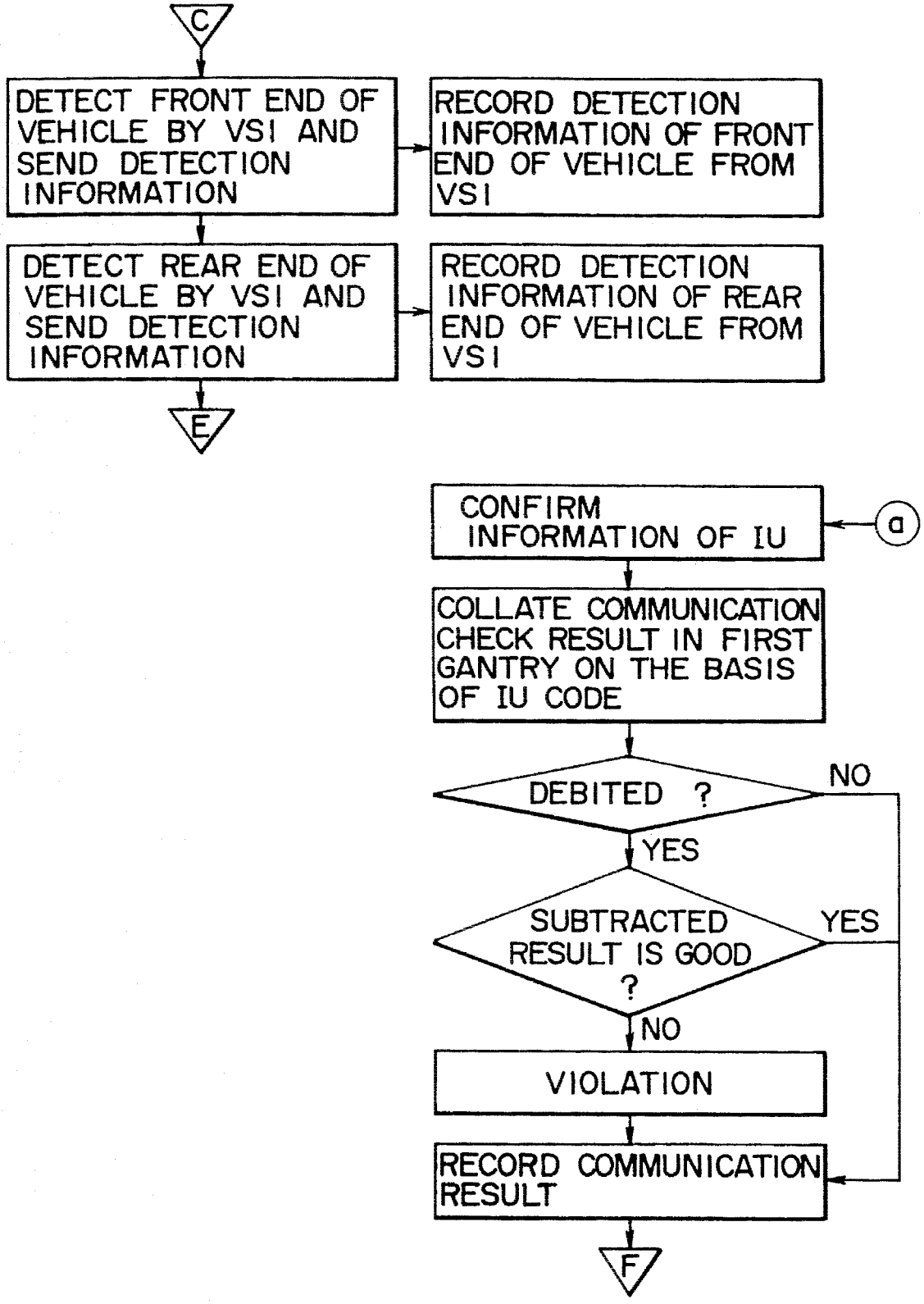
FIGS. 10A and 10B are flow charts showing operation of the electronic traffic tariff reception system of the present invention.
Figure 10B:
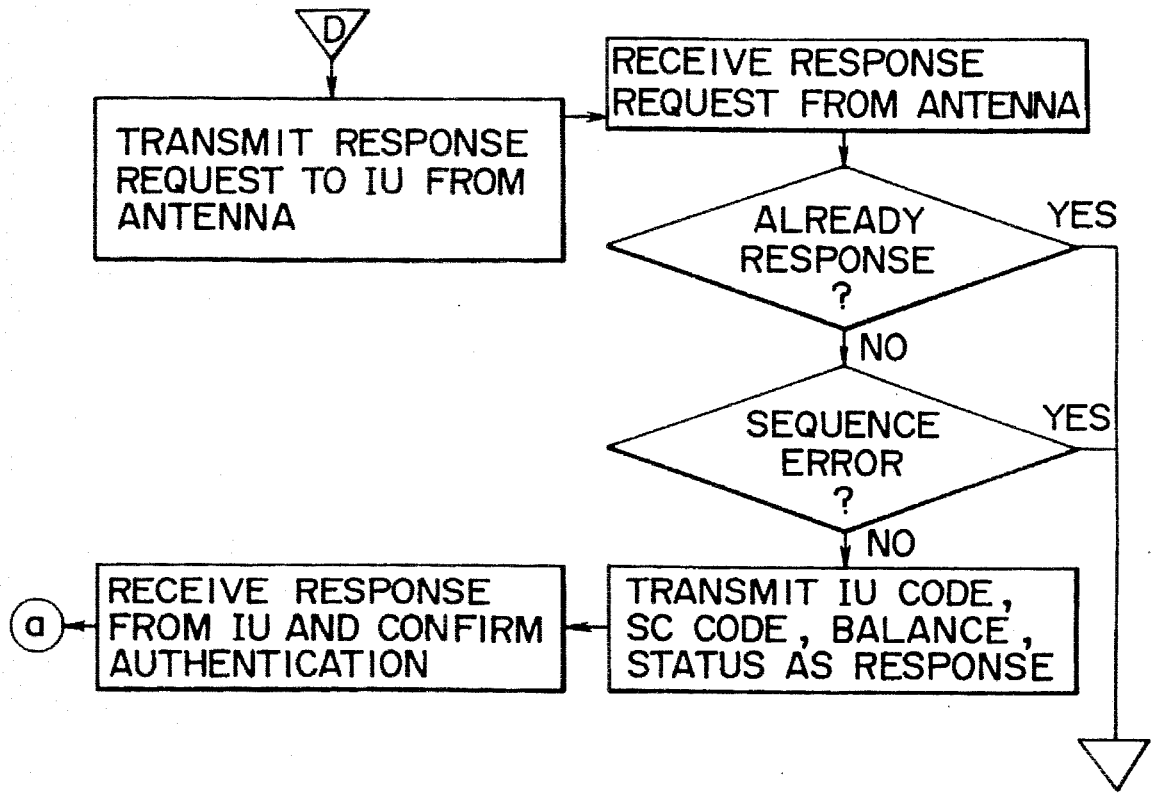
Figure 10:
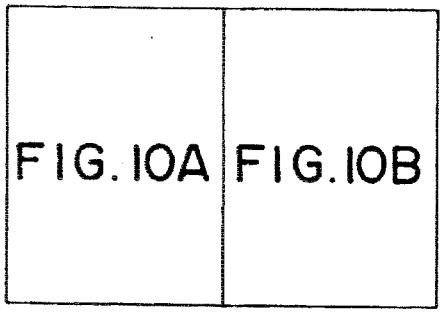

Successively, as shown in FIG. 10, the vehicle detector master controller 31 controls the vehicle detectors 14 to detect the front end and the rear end of the vehicle passing through the second gantry 2 and sends the detected vehicle detection information to the local controller 33. The vehicle detection information includes date, time and the like. Further, the vehicle detection information desirably includes identification information as to whether the detected vehicle is a motorcycle or not and information of motorcycles traveling in parallel on the same lane.

The local controller 33 receives and records the vehicle detection information and starts only the antenna for confirmation 20 to 22 specified by the position of the vehicle passing through the third gantry 3. More particularly, when the vehicle travels in the lane, the antenna for confirmation 20 to 22 corresponding to the lane is started, while when the vehicle travels on two lanes, two antennas for confirmation 20 to 22 corresponding to the two lanes are started (omitted in the flow chart).

It is possible that the antennas for confirmation 20 to 22 are always started in the same manner as the antennas for debiting process 5, 6 and 7 to communicate with the in-vehicle unit 36, while in the embodiment only the antenna for confirmation specified by the local controller 33 is started.

Accordingly, the specific started antenna for confirmation 20–22 transmits the response request signal. The in-vehicle unit 36 mounted in the vehicle passing through the second gantry 2 receives the response request signal and after the authentication transmits the response signal to the antenna for confirmation 20–22. At this time, it is confirmed whether double debiting is made or not and whether there is any sequence error or not. The response request signal and the response signal have the same contents as those used upon passing through the first gantry 1. However, the balance included in the response signal is a value obtained by subtracting the debit value.

The antenna controller 30 which has received the response signal from the in-vehicle unit 36 through the antenna for confirmation 20–22 sends the data to the local controller 33 after the authentication. The local controller 33 confirms the information of the in-vehicle unit 36 by the method of FIG. 8 described above and collates the information with the communication result with the antennas for debiting process 5, 6 and 7 on the basis of the IU code in order to confirm whether there is any error in the identification of the vehicle or not.

It is further confirmed whether the balance is obtained by subtracting the debit value exactly for the vehicle to be debited or not. The vehicle in which the debit value is not subtracted exactly is determined to be the illegally passing vehicle and a communication result is recorded.

Figure 11:
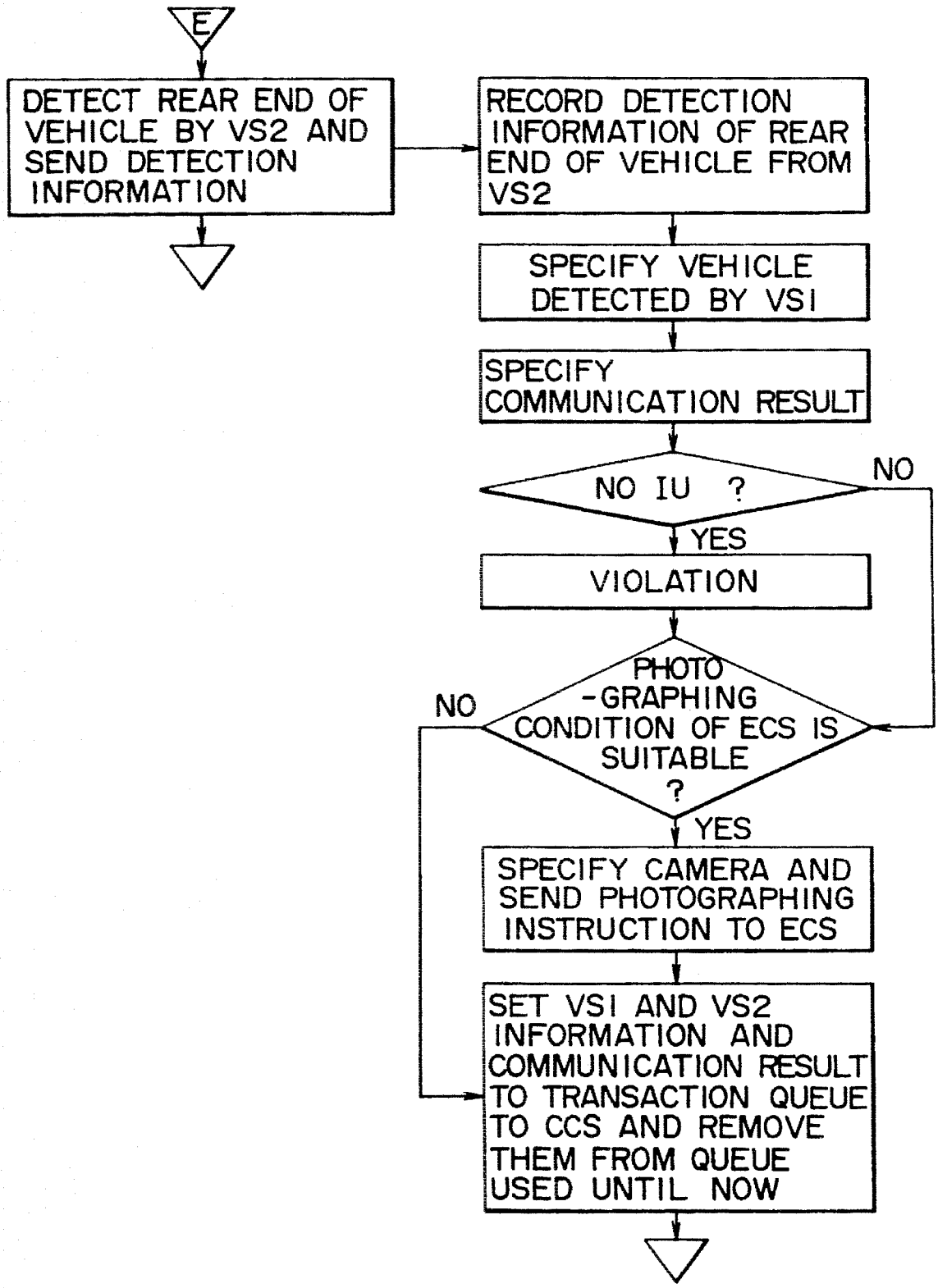
FIG. 11 is a flow chart showing operation of the electronic traffic tariff reception system of the present invention.

Successively, as shown in FIG. 11, the vehicle separator master controller 32 controls the vehicle separators 23 to 28 to detect the rear end of the vehicle passing through the third gantry 3 and sends the detected vehicle detection information to the local controller 33. The vehicle detection information includes date, time and the like. Further, the vehicle detection information desirably includes identification information as to whether the detected vehicle is a motorcycle or not and information of motorcycles traveling in parallel on the same lane.

The local controller 33 receives the vehicle detection signal from the vehicle separator 23–28 and records it. The local controller further collates the vehicle detection signal from the vehicle separator 23–28 with the vehicle detection signal from the vehicle detector 14–19 to specify the passing vehicle. The local controller judges whether the specified vehicle has an in-vehicle unit or not or whether the specified vehicle responds to communication or not or the specified vehicle is an illegally passing vehicle or not from the record of the communication result for the vehicle, or the local controller judges whether the specified vehicle is listed in the blacklist or not and whether the vehicle is regarded as the illegally passing vehicle or not.

The passing vehicle is specified on the premise that the vehicle travels straight in the lane except a motorcycle as a rule and it is considered that movement of the vehicle traveling across the lanes obliquely is within three lanes at the maximum.

When the vehicle is not equipped with the in-vehicle unit or the vehicle is the illegally passing vehicle or the vehicle is listed in the blacklist and is regarded as the illegally passing vehicle, it is judged whether the photographing condition of the illegally passing vehicle photographing system (ECS) is suitable or not.

When the photographing condition is suitable, the monitoring camera 8–13 corresponding to the vehicle specified by the vehicle detection signal is designated and the photographing command is sent to the illegally passing vehicle photographing system (ECS).

The illegally passing vehicle photographing system (ECS) causes the designated monitoring camera 8–13 to photograph a rear image of the illegally passing vehicle including its license plate in response to the photographing command received through the controller interface unit 53.

The image information of the photographed illegally passing vehicle is temporarily held in the camera interface unit 48 and is then displayed in the image display 55 while superposing additional information such as the vehicle detection information, time, place and the like of the vehicle received by the controller interface unit 53. The image information is compressed by the picture processing system and recorded in the hard disk unit 50.

When the image communication command from the central computer system (CCS) is received by the transmission unit 52, the compressed image information (including the additional information) designated by the image communication command is sent to the central computer system (CCS) through the transmission unit 52.

On the other hand, when the photographing condition of the illegally passing vehicle photographing system is not suitable, the photographing operation is stopped and the vehicle detection signal and the communication result obtained by the vehicle detector 14–19 and the vehicle separator 23–28 are sent to the illegally passing vehicle photographing system and are recorded as a passage history of the illegally passing vehicle photographing system. The vehicle detection signal and the communication result are erased after transmitted to the illegally passing vehicle photographing system.

Figure 13:
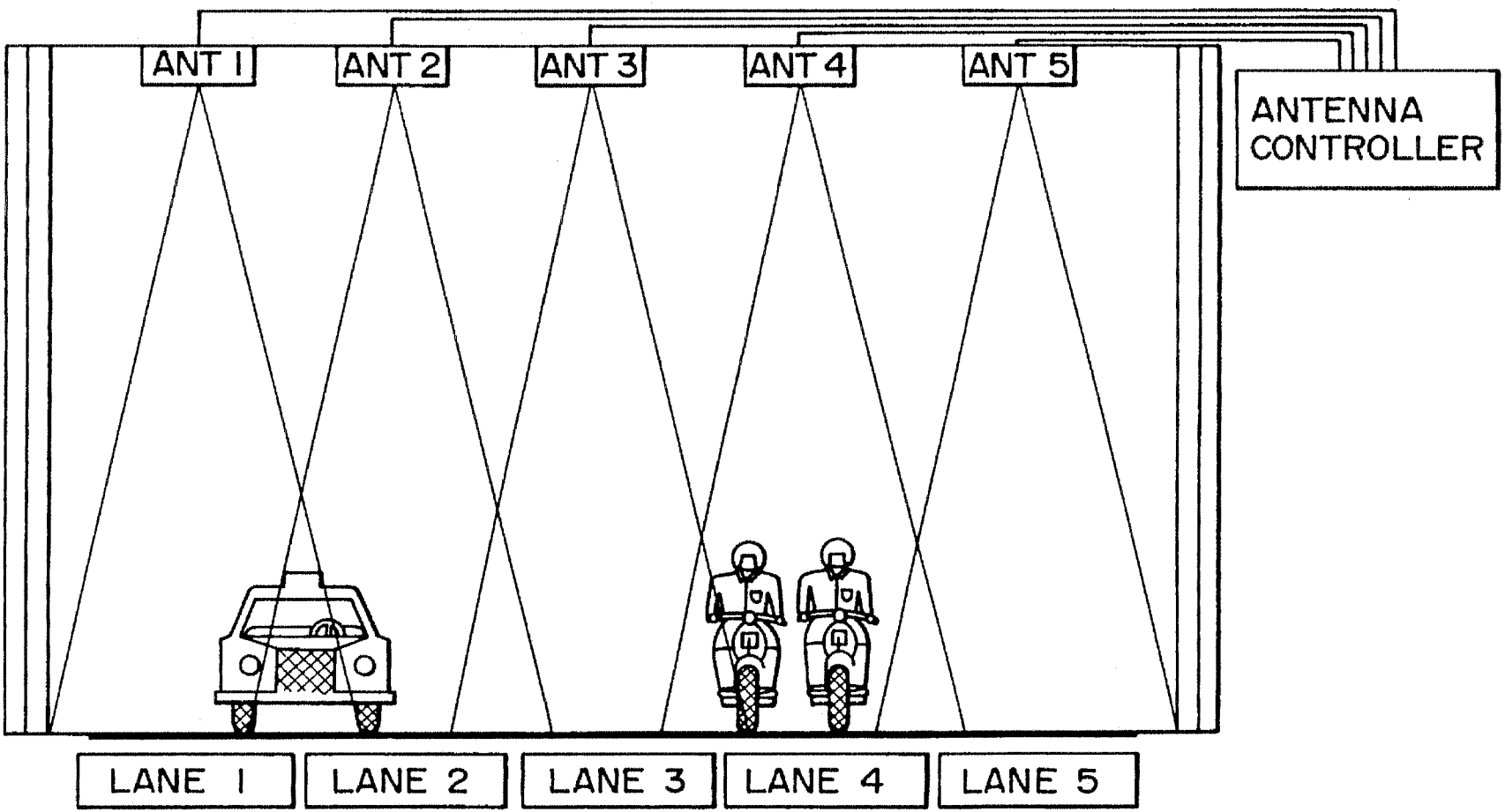
FIG. 13 is a schematic diagram illustrating a layout of antennas for debiting process corresponding to or in association with each lane of a road having a plurality of lanes.

The time sharing multiple accessing method (TDMA) adopted as the radio communication method between the antennas for debiting processing and the in-vehicle unit is now described with reference to FIGS. 13 to 16. For the convenience of description, as shown in FIG. 13, there are five lanes and the antennas for debiting process ANT1 to ANT5 are disposed to cover the respective communication areas. The adjacent communication areas overlap each other partially.

When the antennas for debiting process ANT1 to ANT5 having the communication areas overlapping each other partially transmit simultaneously, the respective signals interfere with each other and there is the possibility that exact reception is impossible.

Accordingly, the antenna controller operates the antennas ANT1 to ANT5 in the time sharing manner.

Figure 14:
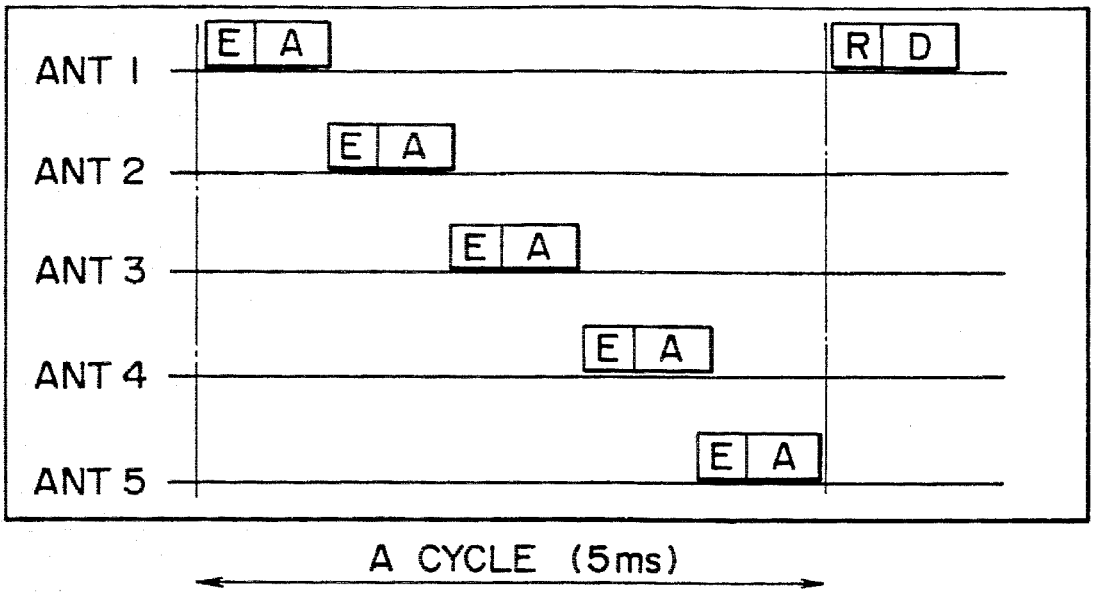
FIG. 14 is a diagram illustrating a time sharing multiple accessing method.

More particularly, as shown in FIG. 14, communication is made between the ANT1 and the in-vehicle unit of the vehicle traveling on the LANE1, then communication is made between the ANT2 and the in-vehicle unit of the vehicle traveling on the LANE2, then communication is made between the ANT3 and the in-vehicle unit of the vehicle traveling on the LANE3, and similarly each of the antennas are successively operated.

The time that communication between all of the antennas ANT1 to ANT5 and the in-vehicle units of the vehicles traveling on the LANE1 to LANE5 is completed is defined as one cycle and subsequently communication between the ANT1 and the in-vehicle unit of the vehicle traveling on the LANE1 is made repeatedly.

As communication contents, the antenna transmits the response request signal E to the in-vehicle unit and the in-vehicle unit responds to the response request signal to transmit the response signal A including the vehicle information such as the IU code, the smart card code and the like and the personal information to the antenna.

The antenna controller determines whether the vehicle is debited or not on the basis of the IU code, the smart card code and the like included in the signal A and further determines the debit value.

After the elapse of one cycle, when the vehicle is to be debited, information including the debit value is transmitted as a signal R from the antenna. The in-vehicle unit which has received the signal transmits the response completion signal D to the effect that the signal has been received exactly.

That is, after the antenna and the in-vehicle unit have communicated with each other by means of the response request signal E and the response signal A, the actual transmission contents are transmitted as the signal and confirmation is made by the response completion signal D.

As described above, even when the communication areas of the plurality of antennas overlap each other, interference between the antennas can be prevented by operating the antennas in the time sharing multiple manner.

However, when a plurality of in-vehicle units respond to one antenna, for example, when in-vehicle units of two motorcycles traveling in parallel in one lane respond to one antenna at the same time, there is the possibility that electric waves are received by the antenna simultaneously. Its probability is considered to be very rare but it can not be assert that it does not occur.

Thus, such a case is supposed and the time sharing multiple antenna operation is repeated with a predetermined time delay.

Figure 15:
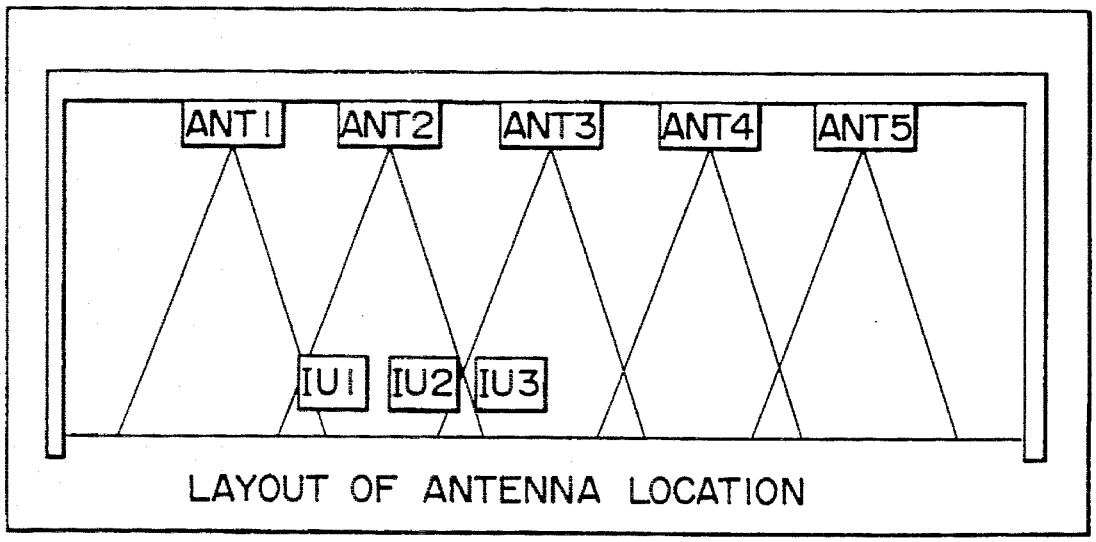
FIG. 15 is a diagram illustrating a positional relation of the communication areas of the antennas for debiting process and the vehicles.

More particularly, as shown in FIG. 15, when two in-vehicle units 1 and 2 exist within the communication area of the ANT2 and an in-vehicle unit 3 exists within the overlap portion of the communication areas of the ANT2 and ANT3, the in-vehicle units 1, 2 and 3 respond to the response request signal E from the ANT 2 to return the response signals A simultaneously, so that the three response signals A interfere with each other in the ANT2.

When such a simultaneous reception of electric waves occurs, the antenna controller can not identify that the in-vehicle units exist within the lane. Thus, the antenna controller transmits the response request signal repeatedly through the antenna.

On the other hand, when the signal R concerning the debiting information is transmitted from the antenna within a predetermined time after the in-vehicle units 1, 2 and 3 has transmitted the response signal A simultaneously, it is assumed that the simultaneous reception of electric waves occurs and after any time defined by random numbers N is delayed, the response signal A is transmitted in response to the response request signal E.

Figure 16:
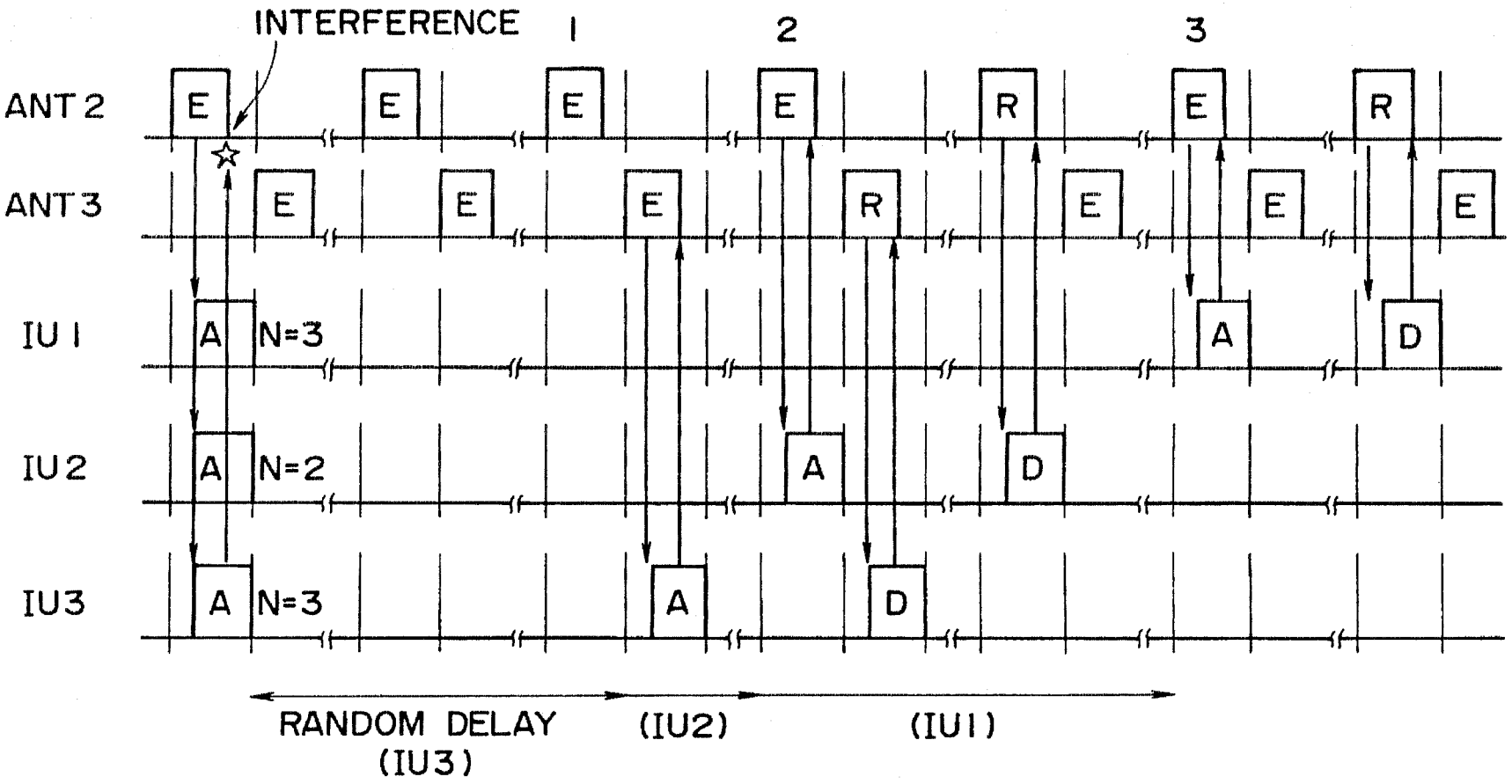
FIG. 16 is a diagram illustrating the time sharing multiple accessing method.

For example, as shown in FIG. 16, when random number N=3 in the in-vehicle unit 1, the in-vehicle unit 1 responds to the response request signal E from the ANT2 to transmit the response signal A after a delay time of three times of one cycle time. When random number N=2 in the in-vehicle unit 2, the in-vehicle unit 2 responds to the response request signal E from the ANT2 to transmit the response signal A after a delay time of two times of one cycle time. When random number N=3 in the in-vehicle unit 3, the in-vehicle unit 3 responds to the response request signal A from the ANT3 to transmit the response signal A after a delay time of three times of one cycle time.

When the random numbers of the in-vehicle units are coincident with each other accidentally, simultaneous reception of electric waves occurs again. However, by producing random numbers repeatedly and repeating communication with a predetermined delay time until communication is completed normally, response can be exactly made finally.

In this manner, even when a plurality of vehicles travel in parallel or continuously in close proximity to each other or at a high speed or in the crowd state within the communication area of one antenna, communication between the in-vehicle units and the antennas can be made exactly successively by adoption of the TDMA method and accordingly the vehicle can be identified to be debited exactly.

The above description has been made to the case of a road having a plurality of lanes, while even if a road has a single lane, it is anticipated that motorcycles travel in parallel and accordingly the TDMA method is very useful.

[Embodiment 2]

Figure 17:
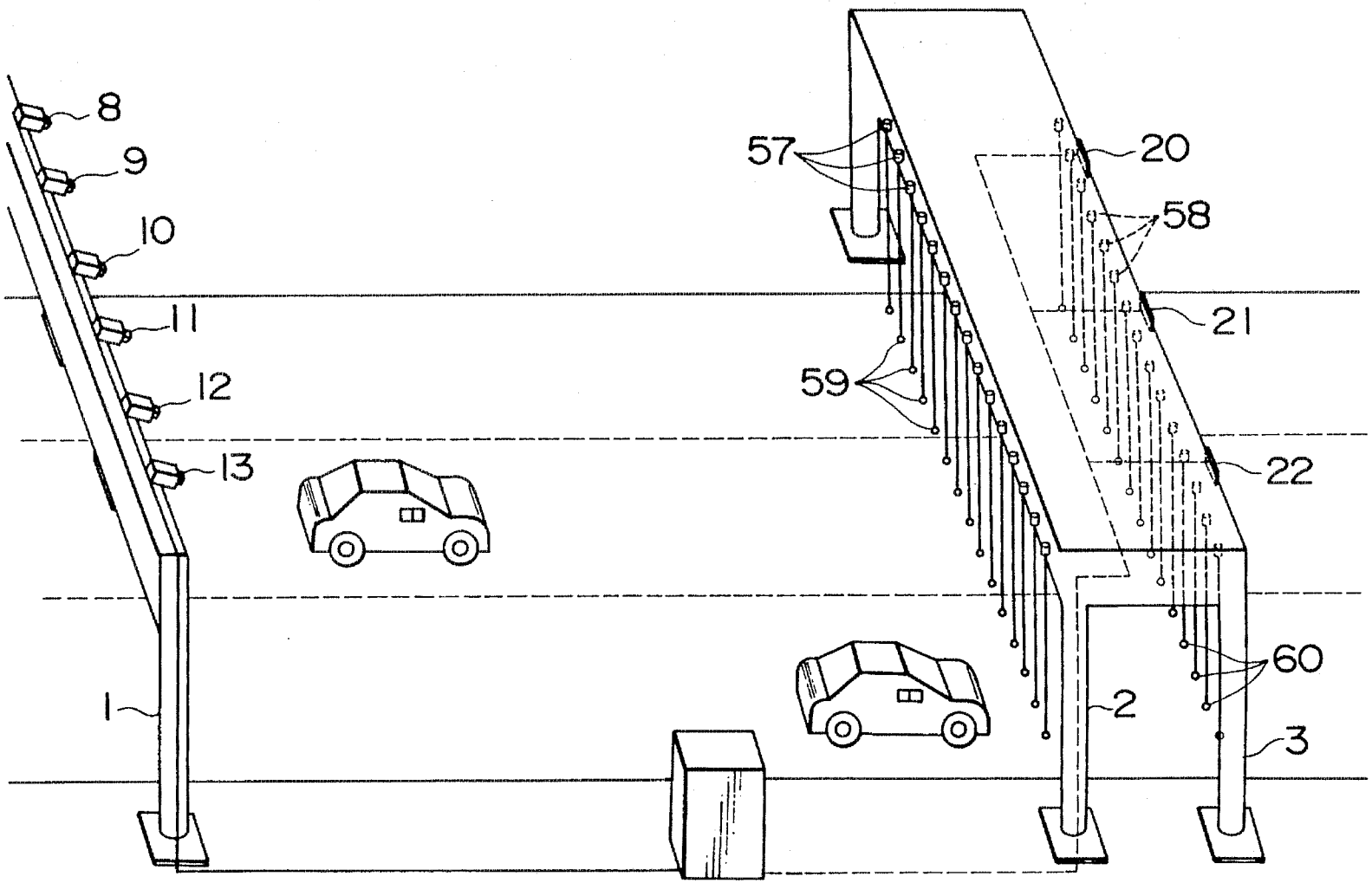
FIG. 17 is a perspective view illustrating a modification of a three-gantry system according to a second embodiment of an electronic traffic tariff reception system of the present invention.
Figure 18:
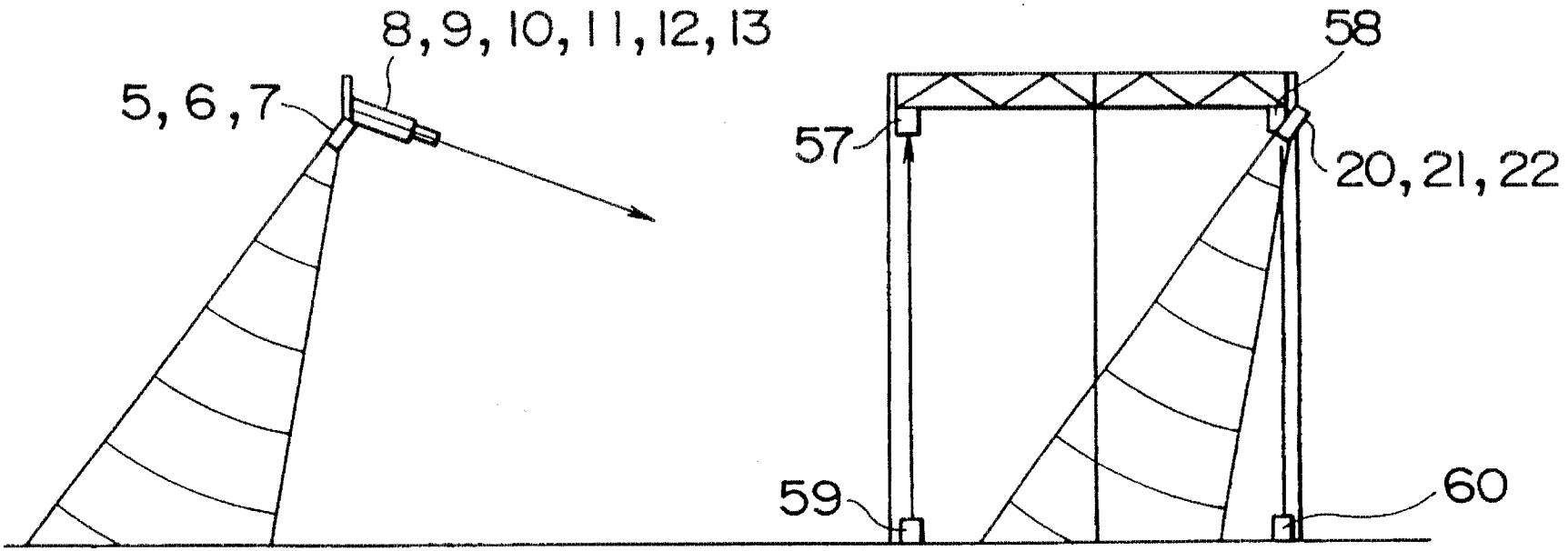
FIG. 18 is a schematic diagram illustrating a layout of the three-gantry system of the second embodiment.

A second embodiment of the present invention is now described with reference to FIGS. 17 and 18. This embodiment is a modification of the first embodiment 1 and uses photoelectric tubes instead of the one-dimensional CCD cameras as the vehicle separators 23 to 28 and the vehicle detectors 14 to 19.

That is, a multiplicity of light receiving units 57 and 58 are arranged in the direction perpendicular to the traveling direction of the vehicle in the second gantries 2 and 3, respectively. A multiplicity of light emitting units 59 and 60 are also arranged on the road just below the light receiving units 57 and 58 in the direction perpendicular to the traveling direction. Other configuration is the same as in the first embodiment and description thereof is omitted.

In the embodiment, when the vehicle does not pass through the second and third gantries 2 nd 3, light emitted upward vertically from the light emitting units 59 and 60 reaches the light receiving units 57 and 58 as it is, while when the vehicle passes through the second and third gantries 2 and 3, light emitted upward vertically from the light emitting units 59 and 60 is interrupted by the vehicle and does not reach the light receiving unit 57 and 58.

Accordingly, by analyzing the signals detected by the light receiving units 57 and 58, it is possible to detect positions in the traveling direction and the width direction of the vehicle.

Specifically, in the method using the photoelectric tubes as the vehicle separators and the vehicle detectors as in the embodiment, a dead angle is difficult to occur as compared with the case where the one-dimensional CCD camera is used. Accordingly, a motorcycle traveling in parallel with a large-sized vehicle can be detected exactly.

Further, the vehicle separation accuracy is dependent on an interval of the photoelectric tubes. Accordingly, the closer the photoelectric tubes are disposed, the higher vehicle separation accuracy can be obtained.

Since it is anticipated that the surfaces of the light emitting units 59 and 60 provided in the road become dirty due to passage of the vehicles, the maintenance for washing the road periodically is required.

[Embodiment 3]

A third embodiment of the present invention is now described with reference to FIGS. 19 to 22. This embodiment is directed to a so-called two-gantry system in which the functions of the second and third gantries in the first embodiment are combined into one gantry.

Figure 19:
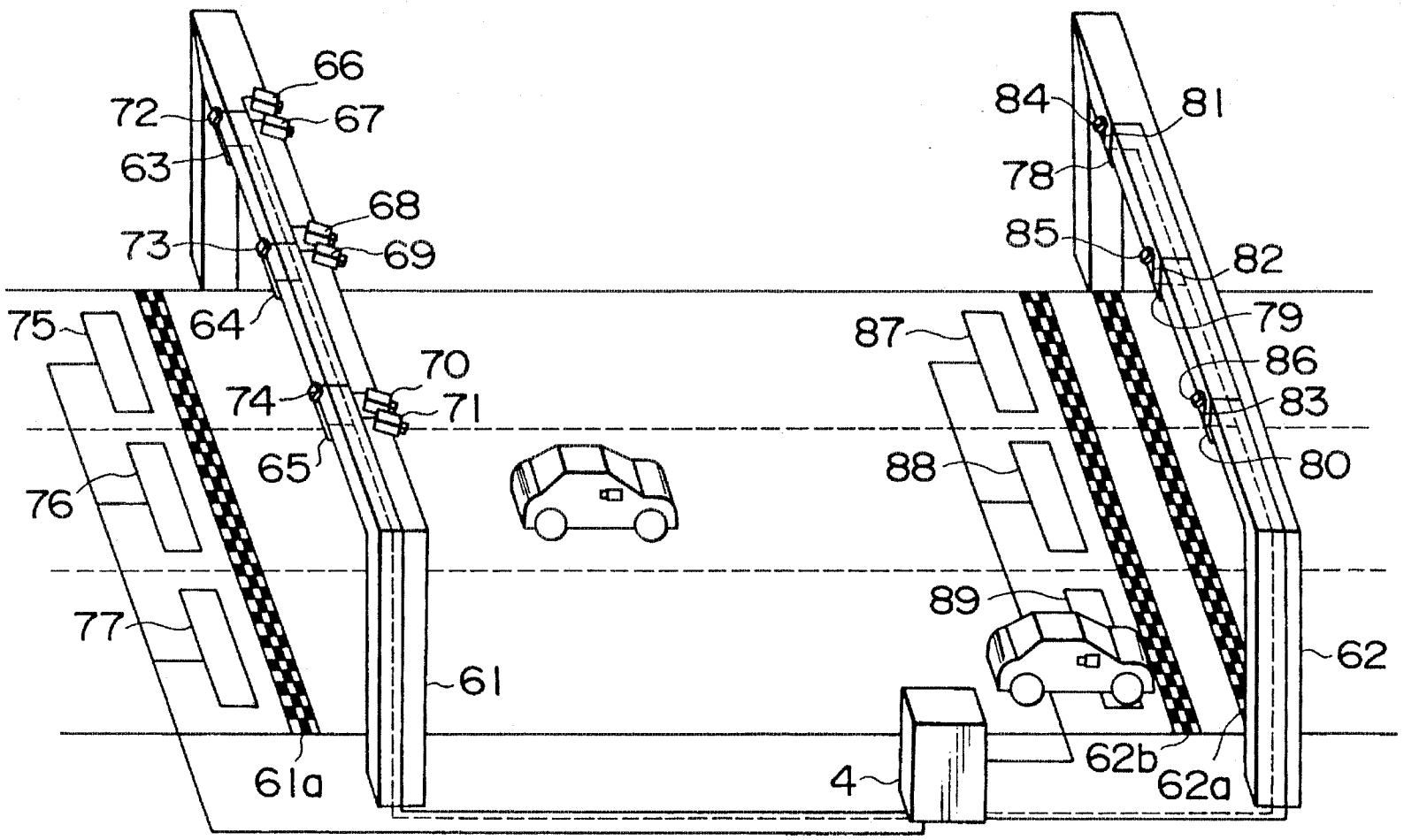
FIG. 19 is a perspective view illustrating a two-gantry system according to a third embodiment of an electronic traffic tariff reception system of the present invention.

More particularly, as shown in FIG. 19, in the outstation, there are provided two gantries 61 and 62 and a control booth 4 in order to realize the traffic tariff automatic debiting system (AVID) and the illegally passing vehicle photographing system (ECS) mainly.

Figure 20:
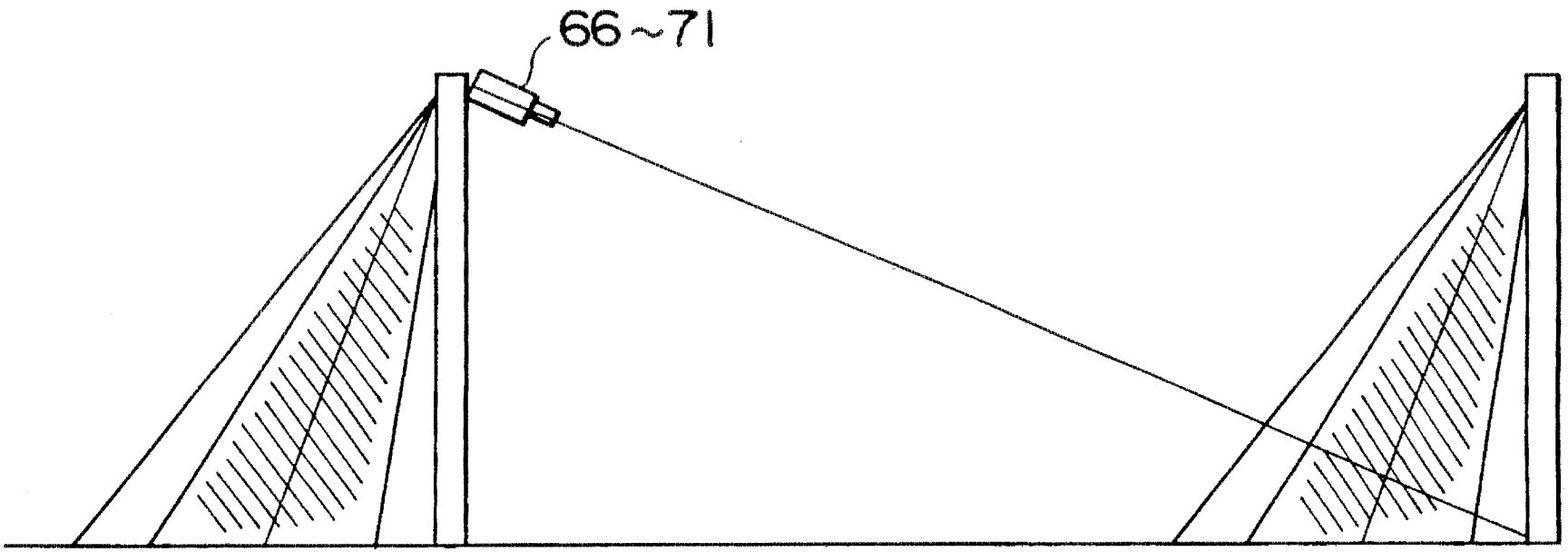
FIG. 20 is a schematic diagram illustrating a layout of the two-gantry system of the third embodiment.

As shown in FIG. 20, a distance between the first gantry 61 and the second gantry 62 in the traveling direction of the vehicle is about 20 m and a height of the first and second gantries 61 and 62 is about 6 m.

Three antennas for debiting process 63, 64 and 65 is mounted in the first gantry 61 in association with each of lanes in the direction perpendicular to the traveling direction of the vehicle and six monitoring cameras 66, 67, 68, 69, 70 and 71 for photographing illegally passing vehicles are also mounted in the first gantry 61 in the direction perpendicular to the traveling direction.

The communication area of the antennas for debiting process 63, 64 and 65 is within the range of from about 1 meter to about 3 meters ahead of the first gantry 61 (hatched portion in FIG. 20).

The monitoring cameras 66 to 71 are mounted to be able to photograph an image including the license plate of the traveling vehicle at the position just after passing through the second gantry 62. The monitoring cameras 66 to 71 use a black-and-white CCD camera with an electronic shutter so as to be able to process the photographed image digitally. While not shown in the drawing, it is desirable to provide an illumination device in consideration of the case where an mount of light in the outdoors is lacking.

One-dimensional CCD cameras are mounted in the first gantry 61 as three vehicle detectors 72, 73 and 74 in correspondence to the lanes in the direction perpendicular to the traveling direction of the vehicle and the vehicle detectors 72, 73 and 74 are set to photograph about 1 meter ahead of the communication area of the antennas for debiting process 63, 64 and 65 obliquely. A periodic black-and-white mark 61*a* is provided on the road at that position in the direction perpendicular to the traveling direction.

Further, loop coils 75, 76 and 77 are provided on the road just before the periodic mark 61*a* in association with each of the lanes. The loop coils are provided to be able to detect vehicles more exactly in cooperation with the vehicle detectors 72, 73 and 74. It is well known that the loop coils are used to confirm the presence of the vehicle in accordance with variation of magnetic permeability and accordingly description thereof is omitted.

On the other hand, three antennas for confirmation 78, 79 and 80 are mounted in the second gantry 62 in the direction perpendicular to the traveling direction in association with the lanes. The communication area of the antennas for confirmation 78, 79 and 80 is within the range of from about 1 meter to about 3 meters ahead of the second gantry 62 (hatched portion in FIG. 20).

Disposed in the second gantry 62 in the direction perpendicular to the traveling direction in association with the lanes are three vehicle separators 81, 82 and 83 and three vehicle detectors 84, 85 and 86.

The vehicle separators 81, 82 and 83 are set to photograph just below the second gantry 62 and a periodic black-and-white mark 62*a* is provided on the road at that position in the direction perpendicular to the traveling direction.

The vehicle detectors 84, 85 and 86 are set to photograph about 1 meter ahead of the communication area of the antennas for confirmation 78, 79 and 80 obliquely and a periodic black-and-white mark 62*b* is provided on the road at that position in the direction perpendicular to the traveling direction.

Loop coils 87, 88 and 89 are provided on the road just before the periodic mark 62*a* in association with the lanes. The loop coils 87, 88 and 89 are provided to be able to detect the vehicle more exactly in cooperation with the vehicle detectors 84, 85 and 86.

The periodic marks 61*a*, 62*a* and 62*b* in the embodiment are formed checkerwise, while the marks may be formed in the grid pattern in the same manner as the first embodiment.

In order to control the antennas for debiting process 63, 64 and 65, the antennas for confirmation 78, 79 and 80, the vehicle detectors 72, 73, 74, 84, 85 and 86, the vehicle separators 81, 82 and 83, and the loop coils 75, 76, 77, 87, 88 and 89, an antenna controller, a local controller, a vehicle detector master controller, a vehicle separator master controller and an illegally passing vehicle photographing system (ECS) are provided in the control booth 4.

Figure 21:
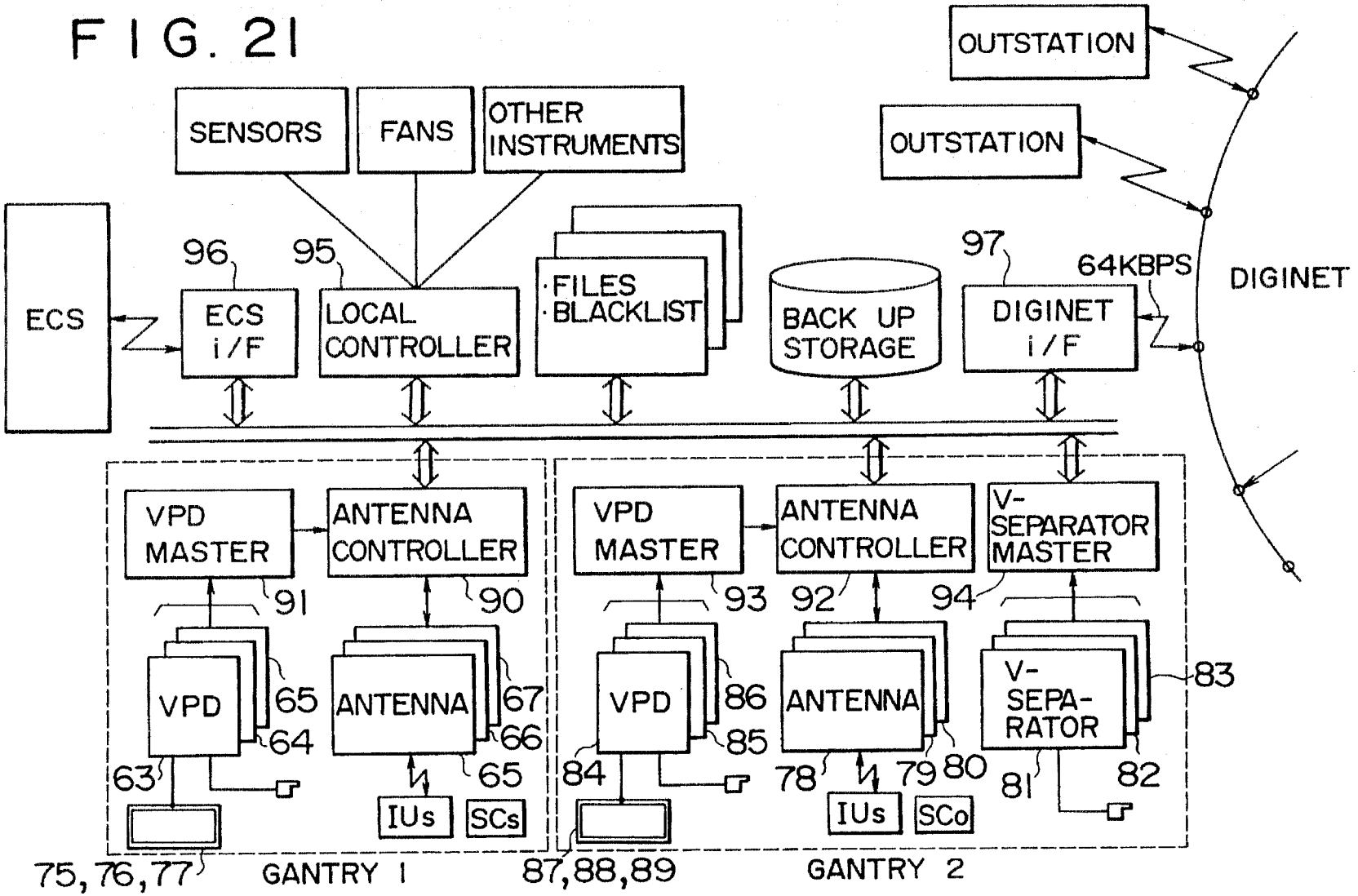
FIG. 21 is a block diagram schematically illustrating the two-gantry system of the third embodiment.

More particularly, as shown in FIG. 21, the antennas for debiting process 63, 64 and 65 are connected to an antenna controller 90. The antenna controller 90 serves to receive the vehicle information and the personal information and transmit the debit value by means of radio communication with the in-vehicle units through the antennas for debiting process 63, 64 and 65.

The vehicle detectors 63, 64 and 65 and the loop coils 75, 76 and 77 are connected to the vehicle detector master controller 91. The vehicle detector master controller 91 supplies the front end and rear end position of the vehicle detected by the vehicle detectors 63, 64 and 65 and the loop coils 75, 76 and 77 to the antenna controller 90 to start a specific antenna for confirmation.

There is the possibility that others than the vehicles such as, for example, a person, dust, leaves and the like are detected in error when detection is made only by the vehicle detectors 63, 64 and 65, while by combining the loop coils 75, 76 and 77 with the vehicle detectors, it can be identified that others that are not made of metal are not a vehicle. The loop coils 75, 76 and 77 may be used always or in the temporal manner or in the term limited manner or in the limited manner.

The antennas for confirmation 78, 79 and 80 are connected to the antenna controller 92. The antenna controller 92 receives the vehicle information and the personal information by means of radio communication with the in-vehicle unit through the antennas for confirmation 78, 79 and 80.

Further, the vehicle detectors 84, 85 and 86 and the loop coils 87, 88 and 89 are connected to the vehicle detector master controller 93. The vehicle detector master controller 93 supplies the front end and rear end position of the vehicle detected by the vehicle detectors 84, 85 and 86 and the loop coils 87, 88 and 89 to the antenna controller 92 to start a specific antenna for confirmation.

There is the possibility that others than the vehicles such as, for example, a person, dust, leaves and the like are detected in error when detection is made only by the vehicle detectors 84, 85 and 86, while by combining the loop coils 87, 88 and 89 with the vehicle detectors, it can be identified that others that are not made of metal are not a vehicle. The loop coils 87, 88 and 89 may be used always or in the temporal manner or in the term limited manner or in the limited manner.

Further, vehicle separators 81, 82 and 83 are connected to the vehicle separator master controller 94. The vehicle separator master controller 94 sends the rear end position of the vehicle detected by the vehicle separators 81, 82 and 83 to the illegally passing vehicle photographing system (ECS). When the vehicle is the illegally passing vehicle, an image including the license plate of the vehicle is photographed by the monitoring camera (not shown).

The antenna controller 90 and 92, the vehicle detector master controller 91 and 93 and the vehicle separator master controller 94 are connected to the local controller 95. The local controller 95 judges whether the vehicle is debited or not on the basis of the vehicle information and the personal information received by the antennas for debiting process 65, 66 and 67 and whether the vehicle information and the personal information are normal or not. When the vehicle is to be debited normally, the debit value in accordance with the vehicle type is supplied to the antenna controller 90. Further, the vehicle information and the personal information obtained from the antenna controller 90 are collated with the blacklist. When the vehicle information and the personal information are listed in the blacklist, it is regarded that the vehicle is not normal and the vehicle is photographed by the illegally passing vehicle photographing system (ECS).

The illegally passing vehicle photographing system (ECS) specifies a position of the illegally passing vehicle having the vehicle information or the personal information which is judged not to be normal or which is listed in the blacklist or is regarded to be improper by means of the vehicle separators 83, 84 and 85 and causes the monitoring camera 66–71 corresponding to that position to photograph the illegally passing vehicle.

Communication between the illegally passing vehicle photographing system and the local controller 95 and the vehicle separator master controller 94 can be made through the ECS interface 96.

The local controller 95 can communicate with the high-speed digital communication network (Diginet) such as the ISDN connected to the central computer system through the diginet interface 97.

The in-vehicle unit, the smart card and the illegally passing vehicle photographing system can use the same as those of the first embodiment.

The implementation method of the electronic traffic tariff reception system (ERP) of the embodiment is also the same as the first embodiment basically.

However, the antennas for debiting process 65, 66 and 67 are different in that the antennas are not in the always started state and only the antenna which covers the vehicle detected by the vehicle detectors 63, 64 and 65 and the loop coils 75, 76 and 77 is specified and started.

More particularly, when the vehicle approaches the first gantry 61, a lane position of the vehicle is detected by the vehicle detectors 63, 64 and 65 and the loop coils 75, 76 and 77. The detected lane position is sent through the vehicle detector master controller 91 to the local controller 95. The local controller 95 starts the antenna for debiting process corresponding to the lane position to communicate with the in-vehicle unit of the vehicle.

Thus, since a plurality of antennas for debiting process are not in the always started state, the expenses are reduced. Further, since the loop coils 75, 76 and 77 are used together with the vehicle detectors, there is no possibility that others than the vehicle are detected in error.

However, since a plurality of antennas for debiting process are started simultaneously when a plurality of vehicles travel in parallel simultaneously, it is desirable to adopt the time sharing multiple accessing method (TDMA) in order to prevent interference between the antennas.

[Embodiment 4]

Figure 22:
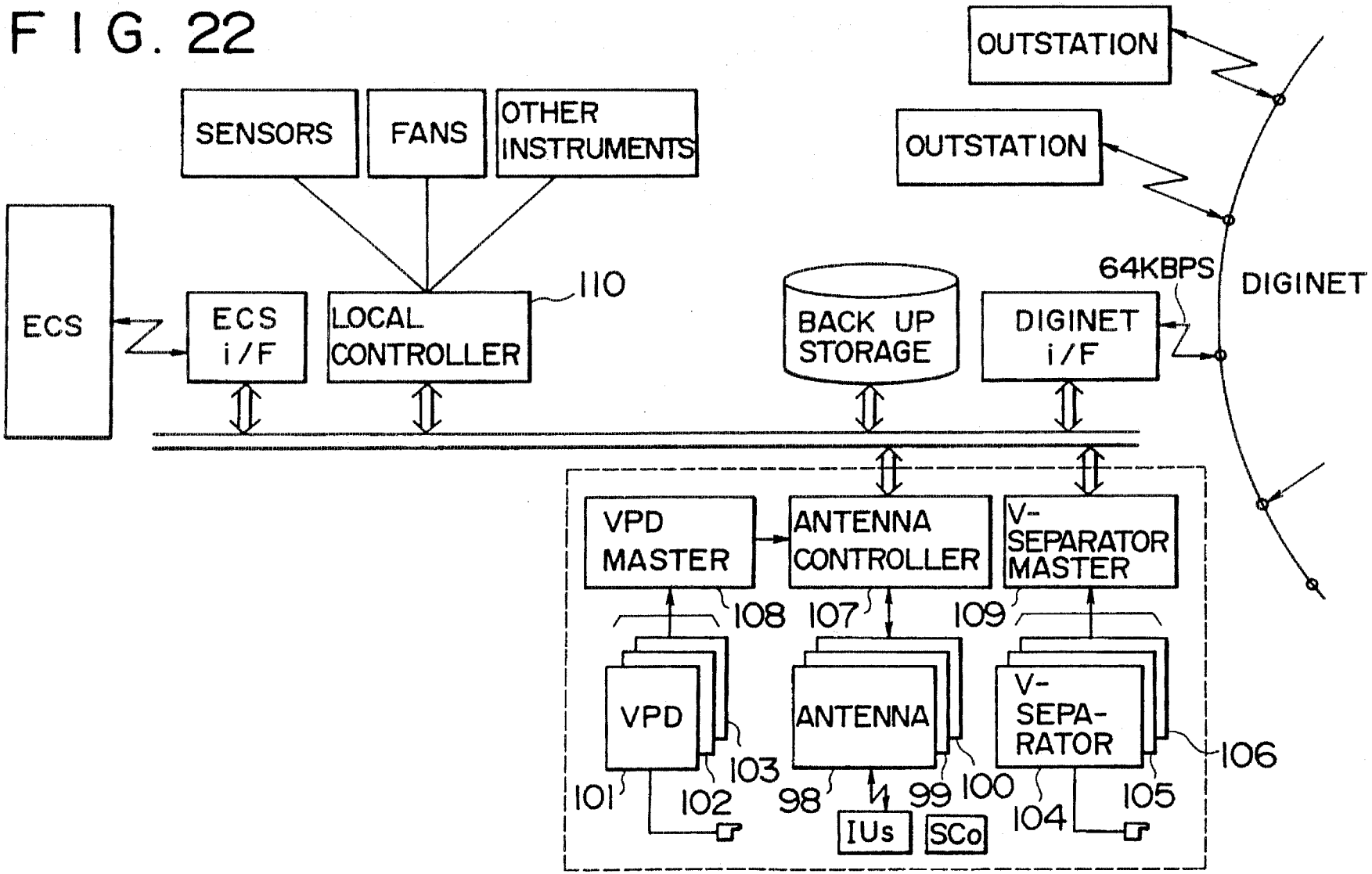
FIG. 22 is a block diagram schematically illustrating a two-gantry system according to a fourth embodiment of an electronic traffic tariff reception system of the present invention.
Figure 23:
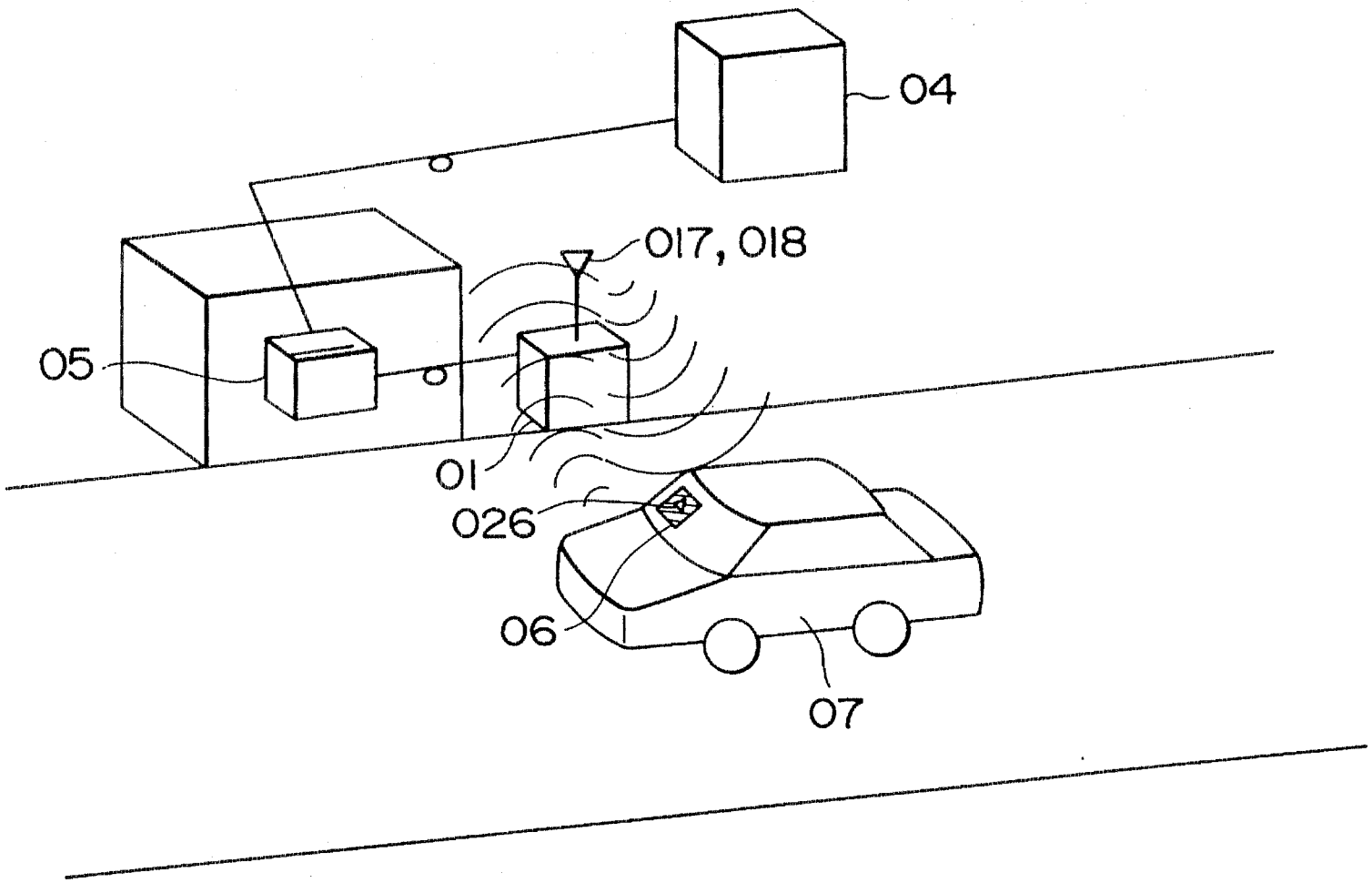
FIG. 23 PRIOR ART
FIG. 23 is a perspective view schematically illustrating a conventional traffic tariff reception system.

A fourth embodiment of the present invention is shown in FIG. 22. This embodiment is directed to a so-called one-gantry system in which functions of the first, second and third gantries are combined into one gantry.

More particularly, as shown in FIG. 22, antennas for debiting process 98, 99 and 100, vehicle detectors 101, 102 and 103, and vehicle separators 104, 105 and 106 are mounted in one gantry in association with each lane and are controlled through an antenna controller 107, a vehicle detector master controller 108 and a vehicle separator master controller by an local controller 110.

In the embodiment, the credit card system (postpaid system) is adopted as the debiting system. The balance is not recorded in the smart card and the antennas for debiting process do not transmit the debit value to the in-vehicle unit. The debit value is not pulled down from the balance of the smart card and is pulled down from the balance of a predetermined bank account later.

Accordingly, in the embodiment, the antenna for confirmation for confirming whether the debit value is pulled down or subtracted in the in-vehicle unit normally or not is not required.

However, in order to photograph a rear image of the illegally passing vehicle, the illegally passing vehicle photographing system must anticipate a traveling time of the vehicle from the vehicle separators 104, 105 and 106 to the photographing position and accordingly a speed sensor for measuring a speed of a vehicle is required.

Further, the local controller has no time for collation with the blacklist until the vehicle reaches the photographing position by the illegally passing vehicle photographing system (ECS). Accordingly, the illegally passing vehicle photographing system photographs all of vehicles and after the photographed vehicles are collated with the blacklist, image signals of the vehicles which are not listed in the blacklist may be erased.

We claim:

1. An electronic traffic tariff reception system comprising an in-vehicle unit mounted in a vehicle travelling freely across lanes of a road having one or two or more lanes and which stores vehicle information which identifies individual vehicles and includes radio communication means; a smart card mounted in said in-vehicle unit and in which personal information of a driver is stored; at least one or more antennas for executing a debiting process, one of said at least one or more antennas being disposed above each lane of the road; an antenna controller for controlling said at least one or more antennas to receive the vehicle information and the personal information and transmit debiting information including a debit value for executing said debiting process by means of radio communication with said in-vehicle unit; a local controller for judging whether the vehicle is to be debited on the basis of the vehicle information and the personal information received by said at least one or more antennas for executing said debiting process and whether the vehicle information and the personal information are associated with a vehicle and an individual person authorized to pass through the tariff reception system and supplying a debit value in accordance with a vehicle type to said antenna controller when the vehicle is to be debited; at least one or more monitoring cameras disposed above each lane of the road; a vehicle separator for detecting a front end, back end, and lateral sides of a vehicle passing through a photographing position of said at least one or more monitoring cameras, said photographing position spanning an entire width of the road, without interruption, so that vehicles need not slow down and need not remain in one of the lanes when passing through the tariff reception system; and means for photographing illegally passing vehicles, including means for specifying via said vehicle separator a position of an illegally passing vehicle having the vehicle information or the personal information which is judged to be unauthorized by said local controller and causing one of said at least one or more monitoring cameras corresponding to the specified position to photograph the illegally passing vehicle.

2. The electronic traffic tariff reception system according to claim 1, wherein said antenna controller controls said at least one or more antennas to perform radio communication via said at least one or more antennas in a time sharing manner in order to prevent interference between said at least one or more antennas when a plurality of said at least one or more antennas are provided.

3. The electronic tariff reception system according to claim 2, wherein said antenna controller transmits a response request signal to said in-vehicle unit repeatedly until a response signal is received without disruption when a plurality of in-vehicle units respond to the response request signal from said at least one or more antennas by transmitting respective response signals simultaneously, and when the debiting information has not been received from said at least one or more antennas within a predetermined time after an initial transmission of the response signal, said in-vehicle unit transmits the response signal again in a time sharing manner in response to the response request signal after a different delay time defined by random numbers.

4. The electronic traffic tariff reception system according to claim 1, comprising a vehicle detector for detecting a position of the vehicle along a width dimension of the road and wherein said antenna controller activates only one of said at least one or more antennas corresponding to a lane which encompasses said position in order to prevent interference between said at least one or more antennas.

5. The electronic traffic reception system according to claim 4, wherein said vehicle detector comprises a one-dimensional photosensor disposed above the road in a direction perpendicular to a traveling direction of the vehicle.

6. The electronic traffic tariff reception system according to claim 5, and further comprising a mark provided on the road at a detection position of said photosensor and having a color shade which varies periodically in the direction perpendicular to the traveling direction, said one dimensional photosensor being responsive to any obstruction of said mark by a vehicle.

7. The electronic traffic tariff reception system according to claim 1, wherein said vehicle separator comprises a one-dimensional photosensor disposed above the road in a direction perpendicular to a traveling direction of the vehicle.

8. The electronic traffic tariff reception system according to claim 1, wherein said vehicle separator comprises a one-dimensional photosensor disposed above the road in a direction perpendicular to a traveling direction of the vehicle, and further comprising a mark provided on the road at a detection position of said photosensor and having a color shade which varies periodically in the direction perpendicular to the traveling direction.

9. The electronic traffic tariff reception system according to claim 1, wherein said local controller collates the vehicle information and the personal information obtained from said antenna controller with a blacklist of persons who are not authorized to pass through the tariff reception system and considers that the vehicle is not authorized when the vehicle is listed in the blacklist to thereby cause said means for photographing illegally passing vehicles to photograph the vehicle.

* * * * *